US006910605B2

(12) United States Patent
Schuckmann et al.

(10) Patent No.: US 6,910,605 B2
(45) Date of Patent: Jun. 28, 2005

(54) PUMP WHICH CAN BE ACTUATED BY A HAND LEVER

(75) Inventors: Alfred von Schuckmann, Winnekendonker Str. 52, Kevelaer (DE), D-47627; Werner Petzold, Lohne (DE)

(73) Assignee: Alfred von Schuckmann, Kevelaer (DE)

( * ) Notice: Subject to any disclaimer, the term of this patent is extended or adjusted under 35 U.S.C. 154(b) by 0 days.

(21) Appl. No.: 10/471,391

(22) PCT Filed: Mar. 6, 2002

(86) PCT No.: PCT/EP02/02485

§ 371 (c)(1),
(2), (4) Date: Feb. 20, 2004

(87) PCT Pub. No.: WO02/072277

PCT Pub. Date: Sep. 19, 2002

(65) Prior Publication Data

US 2004/0118877 A1 Jun. 24, 2004

(30) Foreign Application Priority Data

Mar. 10, 2001 (DE) ..... 101 11 576

(51) Int. Cl.[7] ..... B67D 5/40

(52) U.S. Cl. ..... 222/383.1; 222/321.8; 222/341

(58) Field of Search ..... 222/383.1, 380–382, 222/384–385, 321.6, 321.7, 312.8, 321.9, 321.1, 340–341, 323–324, 372; 239/333, 331, 493, 491, 329

(56) References Cited

U.S. PATENT DOCUMENTS 3,768,734 A * 10/1973 Anderson et al. ..... 239/333
5,423,460 A 6/1995 Thomann
5,716,008 A 2/1998 Nottingham et al.
5,947,341 A * 9/1999 Montaner et al. ..... 222/340
6,116,472 A * 9/2000 Wanbaugh et al. ..... 222/340
6,234,412 B1 * 5/2001 von Schuckmann ..... 239/333
6,439,481 B2 * 8/2002 von Schuckmann ..... 239/333
6,578,742 B1 * 6/2003 Schuckmann ..... 222/383.1

FOREIGN PATENT DOCUMENTS

DE 19913668 9/2000
EP 360949 A1 * 4/1990 ..... B05B/11/00

OTHER PUBLICATIONS

Patent Abstracts of Japan, Publication No. 05218214 A, Date of publication of application: Aug. 27, 1993.

* cited by examiner

*Primary Examiner*—Frederick C. Nicolas
(74) *Attorney, Agent, or Firm*—Martin A. Farber

(57) ABSTRACT

Pump (4) which is actuable by a hand lever for spraying liquid (3), especially for placing on bottles (1) with a pump piston (13) which is linearly displacable in a pump chamber (17) on a housing side, against force of a compression spring, for spraying the liquid (3) out of a mouthpiece nozzle (24). the pump piston (13) being coupled to the pin-mounted hand lever (6) by a connecting pull member (G), the connecting pull member (G), extending from a rear side (49) of the pump piston (13), parallel to the displacement path of the pump piston in the direction of the mouthpiece nozzle (24), and a cross-piece (48) on the rear side (49) of the pump piston (13) as a carrier of the pump piston (13), forming a single element therewith, wherein bearing pin portions (6') of the hand lever (6) are hooked into open slits (9), loaded by compressive force of the compression spring (15) toward a slit end, and wherein an opening (Ö), which is partially surrounded by a frame-shaped the connecting pull member (G) in longitudinal direction of the pump, is pivotable on a hand lever side of a compressed the compression spring (15) over end (25) of a carrying tube (26) to be fitted with mouthpiece (23).

30 Claims, 18 Drawing Sheets

4
23
x
x
6
b
8
43
5
2
3
1
38

XVIII
XVIII
y-y
x-x
z
z

V1
V2
G
Ø
x
y
1
2
4
5
6
6'
7
9
10
12
13
14
17
18
19
19'
20
21
22
23
24
25
26
27
28
29
32
35
36
37
38
39
40
41
43
45
46
48
49
53
55
60
61
62
64
66
67
68
69
70
71
72
73
74
75
76
77
b 4
14
X
48
77
53
49
43
5
1
2
13
12
17
39
19'
18
75
41
40
V1
70
67
V2
66
60
64
G
62
15
Ö
61
68
70
45
27
25
29
X
24
55
28
23
32
10
6'
9
a
7
21
63
22
73
35
36
37
38
b
6

69

70
68
61
62
26
27
64
15
25
y
y
63
29
22
G
x
x
24
45
55
10
28
21
8
b
23
32
6
72
71
7
9
0

64
60
67
70
66
19
19'
17
75
76
39
62
15
18
63
13
35
G
x
x
35
V2
75
73
40
V1
41
8
20
37
36
38

PUMP WHICH CAN BE ACTUATED BY A HAND LEVER

FIELD AND BACKGROUND OF THE INVENTION

The invention relates to a pump which can be actuated by a hand lever for spraying liquids, especially for placing on bottles or the like, with a pump piston which can be linearly displaced in a pump chamber on the housing side, against the force of a compression spring, for spraying the liquid out of a mouthpiece nozzle, the pump piston being coupled to the pin-mounted hand lever by means of a connecting pull member in such a way that the pivoting movement of the hand lever pulls the pump piston in the direction of the liquid moving toward the mouthpiece nozzle, the connecting pull member, extending from the rear side of the pump piston, extending furthermore parallel to the displacement path of the pump piston in the direction of the mouthpiece nozzle, and a cross-piece being provided on the rear side of the pump piston as a carrier of the pump piston, forming a single element therewith.

Pumps which can be actuated by a hand lever are disclosed by DE-A 199 13 668, U.S. Pat. No. 5,716,008, JP-A-52 18214.

The first-cited prior art provides a plug-in connection with the pump piston. The latter has on its correspondingly projecting rear side a hooking-in slit for receiving the cross-piece. The connection is secured by the compression spring of the pump.

In the case of the subject-matter of the next-cited literature reference, the cross-piece has a latching plug-in connection with the closed base of a rolling diaphragm.

The last-cited literature reference makes the proposal to form the cross-piece on the rear side of the piston integrally with the latter. This is a rigid connection. The stirrup-like connecting pull member is in connection with the double-armed hand lever by means of classic pivot pins.

SUMMARY OF THE INVENTION

It is an object of the invention to form a pump of the generic type which can be actuated by a hand lever in a way which is advantageous with respect to its construction and mounting.

This object is achieved in the first instance and substantially in the case of a pump with the features of a first claim, it being provided that bearing pin portions of the hand lever are hooked into open slits, loaded by the compressive force of the compression spring toward a slit end, and that the opening, which is in any event partially surrounded by the frame-shaped connecting pull member in the longitudinal direction of the pump, can be pivoted on the hand lever side of the compressed compression spring over the end of the carrying tube to be fitted with the mouthpiece. The pump piston is pulled into the linearly guiding pump chamber. The frame-shaped connecting member serves in this case as a mounting handle. On account of the opening, the virtually tongue-like formation can be pivoted over the end of the carrying tube. All this takes place against the compressive force of the prestressed compression spring, which is supported on the housing side and pulls the bearing pin portions of the hand lever into the open slits, where it hooks them in. The actuating mechanism is consequently disposed appropriately for actuation. All that remains is for the mouthpiece to be put in place. The subject-matter of the dependent claims are explained below with respect to the subject-matter of the independent claim, but may also be of significance in the form in which they are independently formulated. According to a basic version of the pump which can be actuated by a hand lever, the procedure adopted with regard to the position of the slits is that the slits are open in the direction counter to the compressive force of the compression spring and are formed on a housing of the pump. Conversely, with respect to a variant in this respect, it is also possible to adopt the procedure that the slits are formed on the bearing pin portions of the hand lever with an opening lying in the direction of the compressive force of the compression spring. If a greater accumulation of material is required with respect to the stability of the corresponding formation of the bearing, the housing will be used for forming the slits, since the handle is generally smaller than said dominant basic component. As far as the opening on the connecting pull member is concerned, it is suitably formed in part by a frame-like formation of the hand lever continued to follow on from the connecting pull member. This partial excess length of the opening, which is useful not only for the pivoting mobility of the hand lever but in practice also for the pull-over mounting, is in any case neutralized in terms of length when the hand lever is in the functionally appropriately angled-away position similar to a trigger. It provides the bearing pin portions similar to a fork joint. To secure the mounting position, according to a development the mouthpiece is simply clipped onto the end of the carrying tube. It may comprise such an accumulation of material or be dimensioned in such a way that it serves for securing the mounting position of the connecting pull member. To avoid the deflection of the hand lever pivoting about the bearing pins, which is typical of a lever, the invention makes the proposal that the bearing pin of the hand lever crosses an escape portion directed obliquely upward away from the mouthpiece. In this way, the arcuate space requirement upward/outward is compensated by simple means. For additional securing of the hand lever, the procedure is adopted that the flanks of the bearing slit form snap edges for the bearing pin to pass over. A latching engagement achieved by simple means is accordingly obtained. The number of functional parts can be reduced if the side legs of the frame-shaped connecting pull member are connected by means of film hinges to upwardly directed horns of the hand lever lying above the bearing pin portions. Such horns provide lever arms with respect to the trigger-like actuating arm of the hand lever adjoining underneath the bearing spindle. A configuration useful for the pivoting out and over of the connecting pull member toward the pump piston is obtained by the cross-piece of the frame-shaped connecting member being connected by means of a film hinge to a flat portion reaching to the rear side of the pump piston. The flat portion has at the same time a stiffening effect for the base of the pump piston, which may accordingly have quite a thin wall. A surprisingly stable, cross-sectionally cross-shaped shank is even obtained if the further procedure is adopted that the flat portion has associated upright stabilizing portions. Trouble-free actuation of the mechanism is ensured if the cross-piece runs in a longitudinal slit of the pump cylinder. It is also secured in this way against even minor instances of torsion, which helps the pump to run smoothly in the way desired. With respect to the spring, an advantageous central system is obtained if the compression spring is formed as a frustoconical spring located in the pump chamber. If such a compression spring is not to be exposed in a contacting way to the liquid to be sprayed, an advantageous variant comprises the compression spring being realized as a leaf spring which acts upon the hand lever and is formed integrally with the housing. This at the same time reduces the number of parts. The actuating arm of the hand lever, to be precise the rear side of the latter, is loaded. On the other hand, in structural terms it is also possible to adopt the procedure with respect to the compression spring that the latter is provided as a clip spring with bent, elastically yielding legs, which are fixed at their apex on the mouthpiece side of the hand lever. A different way of disposing the compression spring in such a way that it does not contact the liquid to be delivered is for the compression spring to be formed as a compression spring which lies outside the pump chamber but in any event offers free access at the end. It may be a screw-thread compression spring, that is of a cylindrical type. It suitably extends in or spatially parallel to the direction of pump displacement of the frame-shaped connecting pull member. The actuation takes place via the free access by means of the pump mechanism. The further configuration is characterized by a spring chamber which is fixed to the housing and receives the compression spring in a prestressed manner. The bar-shaped compression spring can be inserted like a cartridge into a cartridge bearing, its position being self-securing by means of the restoring force. The prestressing is applied to an effective degree adequate for correspondingly maintaining an unactuated basic position. The subsequent actuation of the pump mechanism by means of the hand lever takes place with further compression of the compression spring. The latter runs partially inside a cover. The cover is formed on the frame-shaped connecting pull member. It is part of the spring chamber. It is further provided that an actuating finger acting via the free access is formed on the frame-shaped connecting pull member and engages over one end of the compression spring. To achieve a balanced force transmission that is free from tilting with respect to the compression spring, the actuating finger is provided in pairs. For positional securement and mounting of the compression spring inserted into the spring chamber, each end of the compression spring has an associated stop of the spring chamber which is fixed to the housing. The application of the prestressing of the compression spring is based on a shorter length of the spacing between the stops of the spring chamber than the basic length of the screw-thread compression spring. With regard to the pump mechanism, a further advantageous configuration is then obtained by an insert part which simultaneously forms an inlet valve and an outlet valve being disposed in the pump chamber, the outlet valve being formed by a lip extending in the direction of the mouthpiece nozzle and the inlet valve forming a flange extending substantially radially to said direction. Such a radially protruding flange can be formed with a relatively thin wall and is consequently easier in terms of switching than is the case with respect to a lip lifting up at quite an acute angle. Another favorable measure is that the flange engages against a stepped face formed in the pump chamber and extending transversely to the direction of pumping displacement of the pump piston. The engagement may be implemented with a certain slight biasing. The insert part, of an advantageous overall configuration for mounting, is received in an ante-chamber disposed ahead of the pump chamber in the direction of the mouthpiece nozzle. For residual-free delivery of the divided-off liquid from the pump chamber, it proves to be useful for a displacer projection that fills the cup-shaped through low region of the insert part in the actuating end position to be formed onto the pump piston. This can easily be allowed for during injection molding and, moreover, contributes to the inherent stability of the pump piston. The piston can then be disposed in a way which is advantageous for injection molding by the measure that the pump piston is connected to the frame-shaped connecting pull member by means of flexible connecting portions which respectively permit pivoting between the pump piston and the connecting pull member of 90° between the injection-molding position and the mounting position. The connecting portions lie appropriately for pivoting in a common transverse plane, suitably in the diametrical line of the pump piston. The described frame-shaped formation of the connecting pull member is of use for advantageous mold core accessibility, or demoldability. Finally, the proposal is made that the slit end of the slits is widened by an angled-away flange collar. This favors the formation of the bearing, with the addition of a final optimizing measure that hand lever material at the ends of the slits is supportingly drawn against the rear of the flanged collar. In spite of a material-saving wall thickness, a bearing that is supported in respect of its depth is achieved.

BRIEF DESCRIPTION OF THE DRAWING

The subject-matter of the invention is explained in more detail below on the basis of two exemplary embodiments illustrated in the drawing, in which:

(FIG. 11 shows by dash-dotted lines at the same time an intermediate mounting phase, illustrating the pivoting of the connecting pull member over the free end of the carrying tube to be fitted with the mouthpiece)

DETAILED DESCRIPTION OF THE PREFERRED EMBODIMENT

Figure 1:
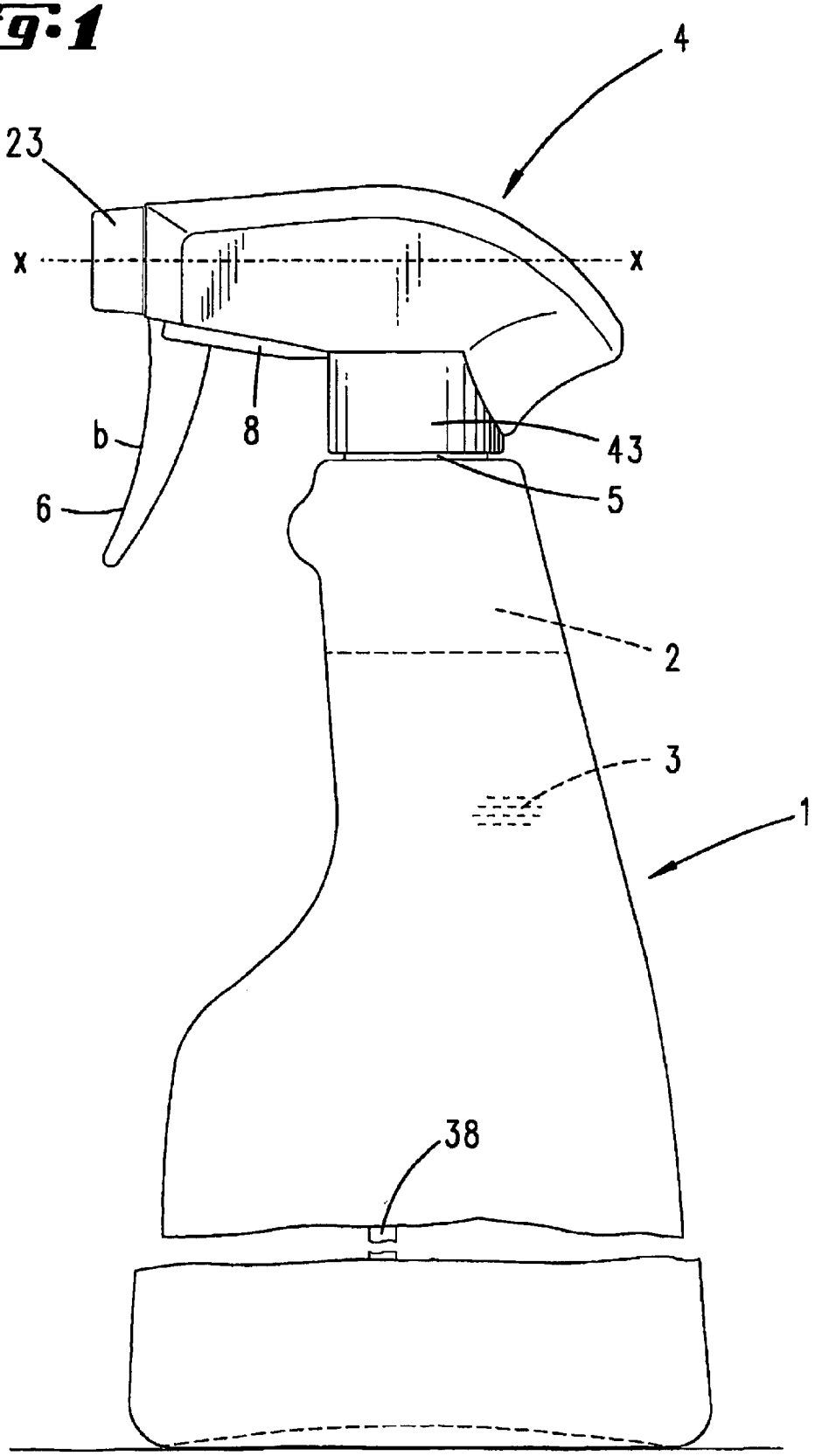
FIG. 1 shows a bottle in side view with a placed-on spray pump, to be precise in the basic position, according to a first exemplary embodiment.

A bottle 1 in the upright position is represented. The bottle interior 2 contains liquid 3 capable of being sprayed and foamed. Serving for corresponding delivery is a spray pump, designated throughout as pump 4.

The pump 4 has been placed onto the neck 5 of the bottle 1. This may be realized, as represented, by screw-connection means, or else by click-on connection or using a bayonet closure. For refilling the bottle 1 with liquid 3, a reversible association of the pump 4, a so-called trigger pump, is preferably provided.

Figure 2:
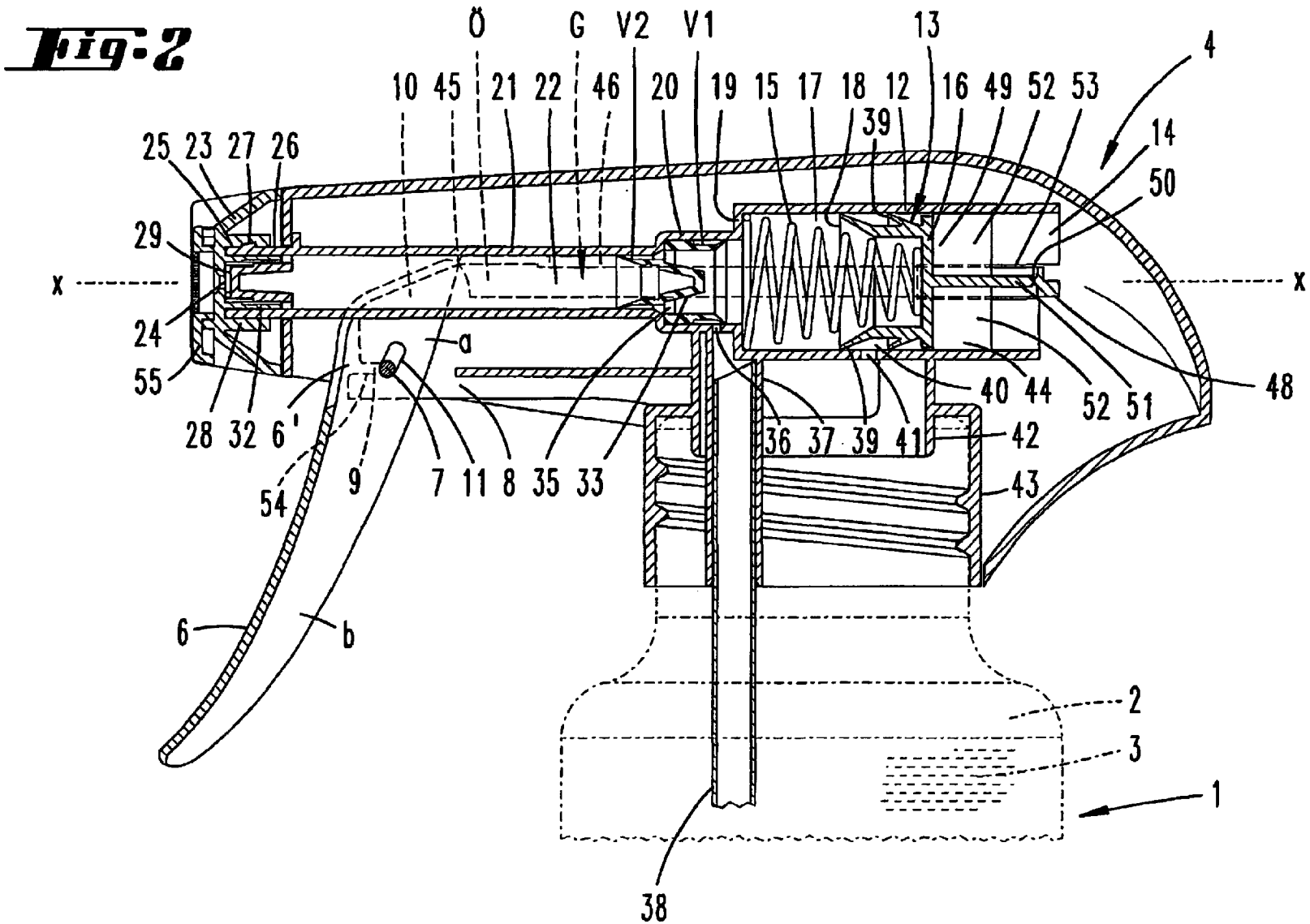
FIG. 2 shows a vertical section through the spray pump with the bottle neck indicated, likewise in the basic position, enlarged.
Figure 3:
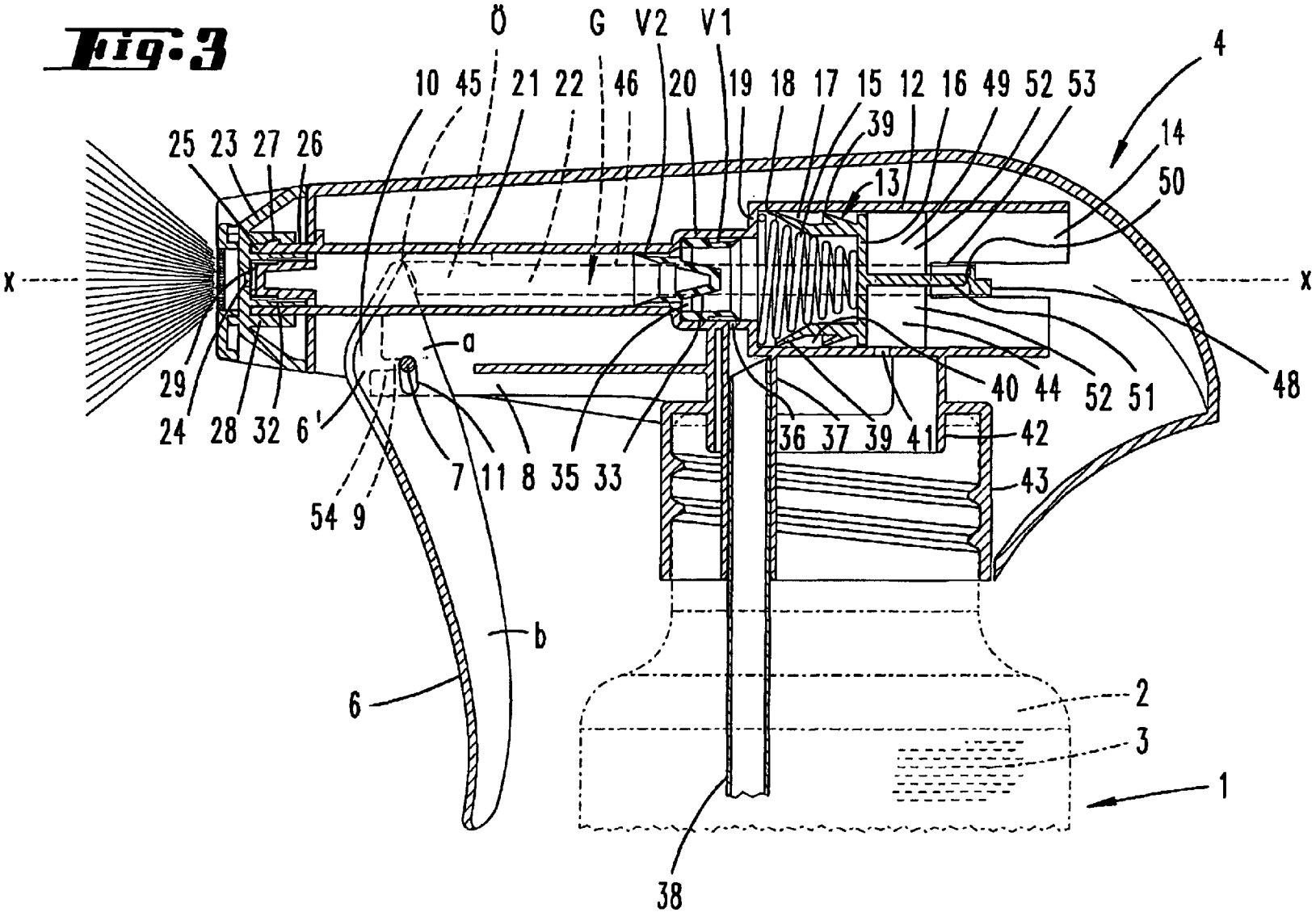
FIG. 3 shows the spray pump in a representation like FIG. 2, but in the state of actuation of its hand lever (in the case of the aforementioned basic version, the compression spring is realized as a frustoconical spring accommodated in the pump chamber)
Figure 7:
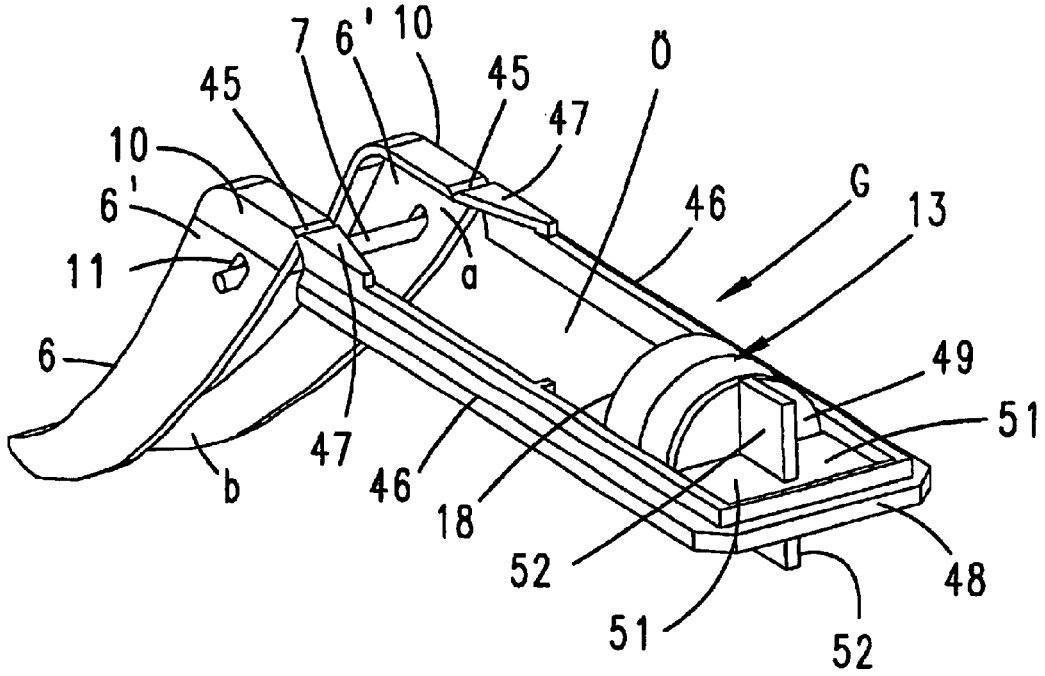
FIG. 7 shows in a perspective representation a hand lever/connecting pull member unit with an integrally formed pump piston.
Figure 13:
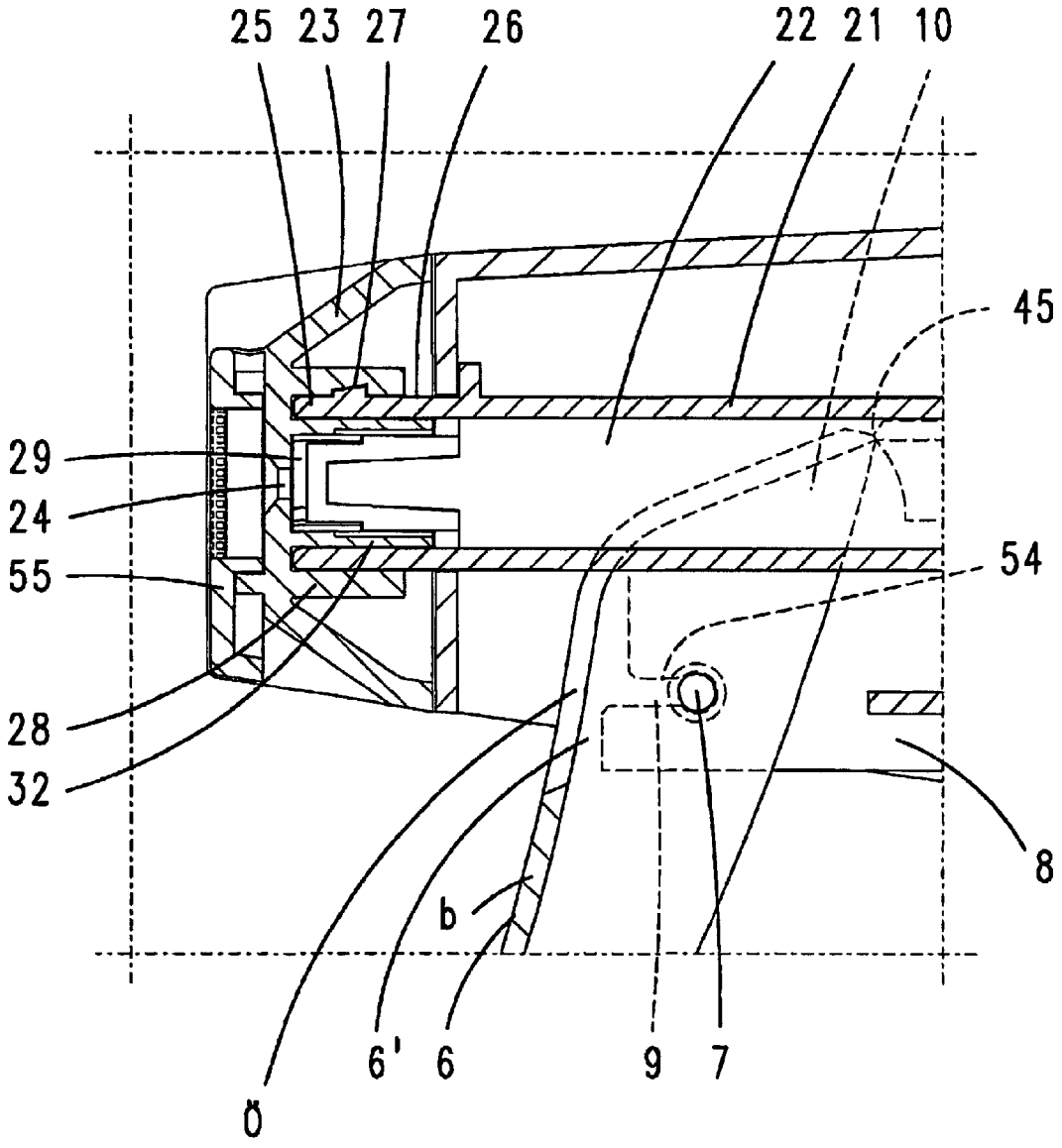
FIG. 13 shows a variant of the hand lever mounting.

The actuating element of the pump 4 is a hand lever 6. This is double-armed and is mounted such that it can be pivoted about a horizontally oriented bearing pin 7. This may be embodied by journals which are provided in pairs and are seated on the hand lever 6 (compare FIG. 13), or else a special knockout spindle which passes through congruently lying apertures or holes in the hand lever 6 (cf. FIGS. 2 and 7).

In both cases, the bearing pins 7 are realized in a bearing pin portion 6' of the hand lever 6. The bearing for the bearing pin 7 is formed by a housing 8 of the pump 4.

The bearing is formed as a horizontal slit 9. This is a slit 9 formed in pairs, so that its tilting-free pivot-mounting for the hand lever 6 is provided. The latter is U-shaped in cross-section. The U opening points toward the neck 5 of the bottle 1.

As far as the double-armed form of the hand lever 6 is concerned, this is embodied in a first arm a, directed inwardly with respect to the housing. Said arm is forked for mounting reasons and consequently provides two horns 10 (cf. for example FIG. 7). To form horns, the U cross-piece of the hand lever 6 is omitted in the region of the bearing pin portion 6', in a manner creating a fork.

The second arm, designated by b, acts as a trigger. The ratio of the lengths of a to b is around 1:4.

The basic version (FIG. 2 et seq.) of the mounting of the hand lever 6 has moreover a further development, which comprises that the separate bearing pin 7 of the hand lever 6 crosses on the housing side an obliquely upwardly aligned escape portion 11. The significance of the latter is more fully explained further below when the actuating mode is described. It is formed in pairs and acts in a pivot-guiding manner on the hand lever 6.

The pump housing 8 consists of plastic. It allows for the incorporation of a piston/cylinder unit 12/13. The pump cylinder 12 of the latter receives a cup-shaped pump piston 13. The latter is plugged into the pump cylinder 12 from the end 14 of the cylinder that is open on the right-hand side and is subjected to spring loading counter to the plugging-in direction, that is to say in the outward direction.

According to the basic version, the spring loading is applied by a wound, preloaded compression spring 15. The latter is supported movably at one end and fixedly at the other end. The cup-shaped pump piston 13 terminates with a transverse base 16. Acting against the latter on the inner side of the piston is the winding that is at the respective end of the compression spring 15 realized as a frustoconical spring, forming the movable abutment. It is the end winding of smaller diameter.

In the basic position, the extreme end 18 of the pump piston 13 facing a pump chamber 17 of the pump cylinder 12 ends at a distance from a step formation 19 in the wall of the pump cylinder 12. The annular flank of the latter, facing the pump chamber 17, forms the fixed abutment for the base winding of larger diameter of the frustoconical compression spring 15. The helical form of the compression spring 15 in combination with its tapering on the piston side provides adequate undisturbed space for the movement of the extreme end 18 of the pump piston 13.

The described wall step formation 19 leads to a tubular intermediate portion 20 of the housing 8 of the pump 4. The clear diameter of the latter is clearly less than that of the pump chamber 17.

The tubular intermediate portion 20 then goes into a further reduced, coaxial tubular portion 21, representing a central channel 22 in the direction of a mouthpiece 23 of the pump 4, on the left-hand side in the drawing. The pump-conveyed liquid 3 passes via said channel 22 to a mouthpiece nozzle 24. In this case, the tubular portion 21 forms with its free end 25 a carrying tube 26 for the mouthpiece 23.

For holding the mouthpiece 23 on the end 25 of the carrying tube 26, a clip connection is used. The clipping means are designated by 27. They are ribs that can be run over on the lateral wall of the carrying tube 26. The counter means, matching the ribs, is a groove in a connecting piece 28 on the pump chamber side of the mouthpiece 23, seated in a rotatably restricted manner on the carrying tube 26. The rotational end positions are restricted such that the mouthpiece 23 can be brought into the closure position with respect to the mouthpiece nozzle 24. The relevant means are commonplace and are not to be explained any further here.

On the housing side, lying behind the wall which provides the central mouthpiece nozzle 24 (cf. FIGS. 8 and 9), there is a swirl chamber 29. Running to this are frontal transverse channels 30, connected preferably to the inflow for liquid 3. The latter channels run tangentially into the basically circular swirl chamber 29.

Figure 8:
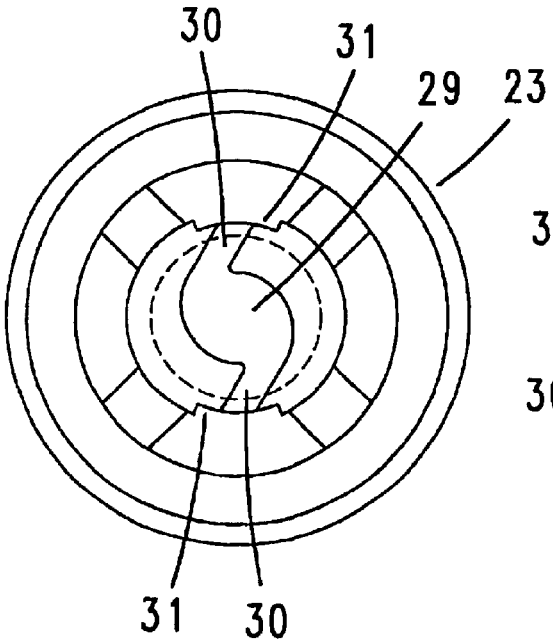
FIG. 8 shows an enlarged view toward the outer region of the mouthpiece nozzle, illustrating a swirl chamber at the extreme end.

According to the variant of FIG. 8, two virtually diametrically opposed transverse channels 30 are realized.

Figure 9:
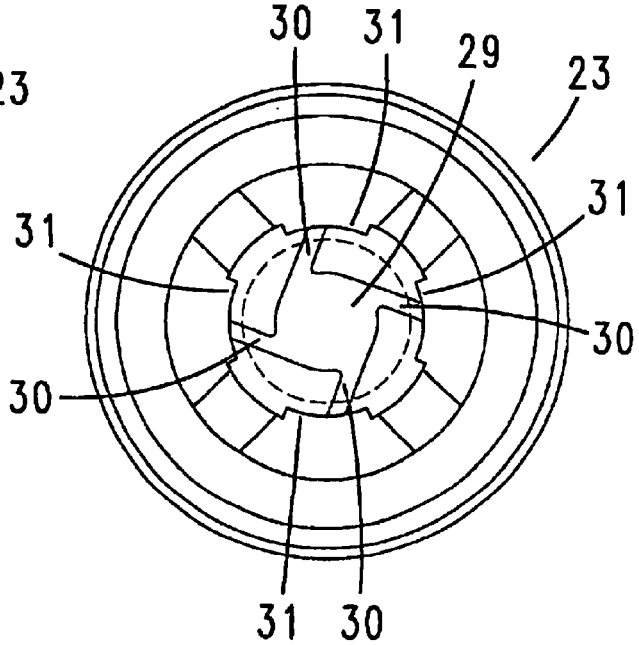
FIG. 9 shows a representation corresponding to FIG. 8, in a modified configuration of the swirl chamber.

In the case of the subject-matter according to FIG. 9, there are four transverse channels 30 disposed such that they are distributed at equal angles, likewise in a tangential type of inflow with respect to the swirl chamber 29, which is consequently supplied via four points.

Said FIGS. 8 and 9 also reveal that the tangential supply also passes via longitudinal channel portions 31. These are in supply connection with the central channel 22 of the pump 4 and are formed by a cylindrical, central core piece, which is held on the mouthpiece 23 by radial cross-pieces.

A barrier wall formed by a second connecting piece 32 controls the supply in the sense of shutting it off or releasing it.

Accommodated inside the chamber of the tubular intermediate portion 20 provided by the wall step formation 19 is an inlet valve V1. This opens when there is negative pressure in the pump chamber 17 and closes when positive pressure occurs there, generated by the movement of the piston.

Disposed coaxially in relation to the inlet valve V1 and ahead of it on the mouthpiece side there is an outlet valve V2. This extends in the respective transitional region to the tubular portion 21, which in its inner wall provides the valve-seat face. The outlet valve V2 is actually formed by an elastic annular lip. This can be flowed behind peripherally in the delivery direction of the liquid 3. In the opposite direction there is likewise an annular lip on the inlet valve V1. This lip can only be lifted off from the inner wall of the tubular intermediate portion 20 as a valve-seat face, that is flowed behind, in the sense of filling of the pump chamber 17.

Inlet valve V1 and outlet valve V2 are formed as one part. They consist of material capable of recovery, such as rubber or rubber-like plastic.

Figure 12:
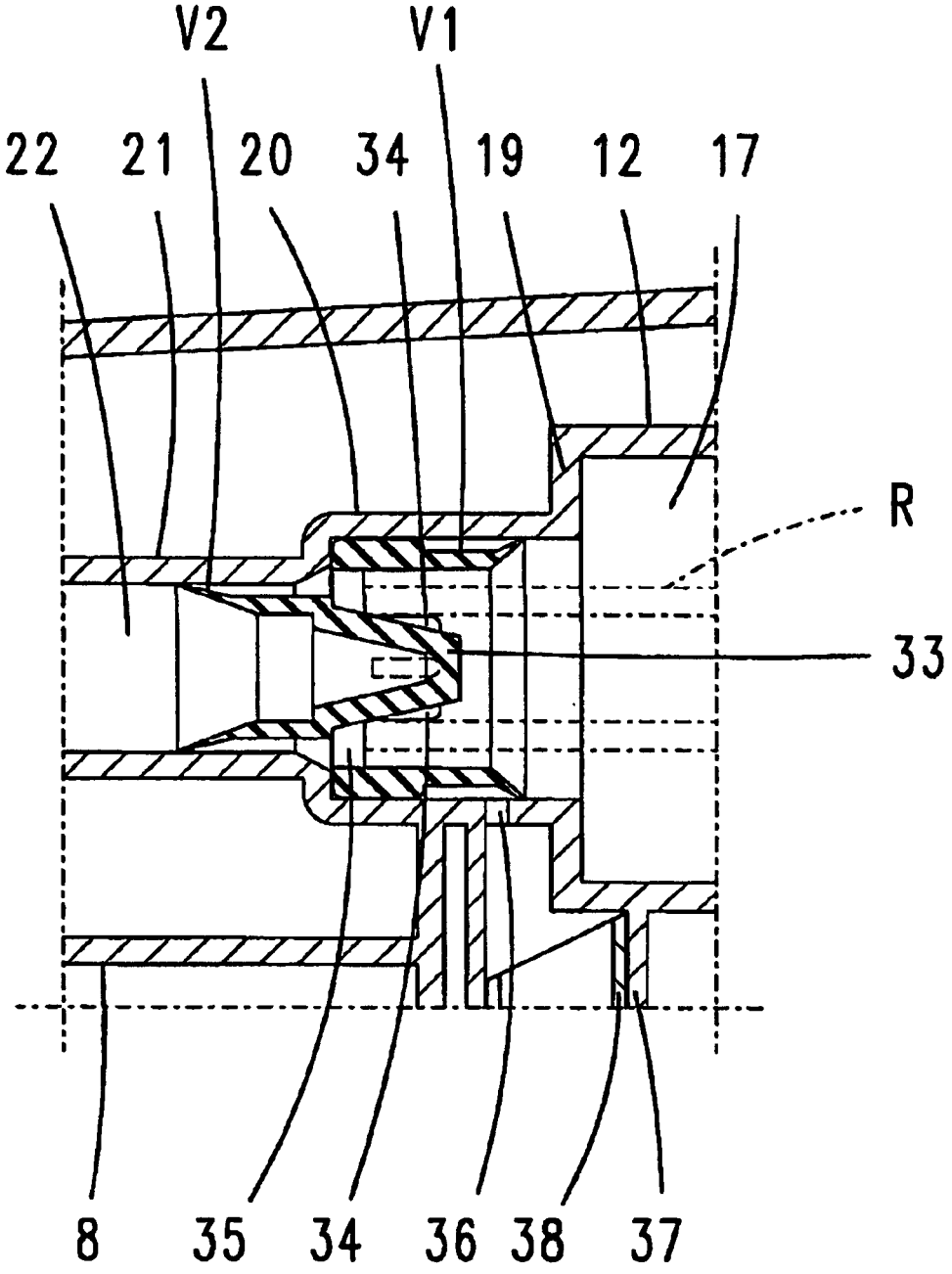
FIG. 12 shows an enlarged extract from FIG. 2.

The base of the outlet valve V2 is formed as a frustoconical body 33 exposed in the direction of the pump chamber 17. This acts at the same time as a mounting aid, in that the tube R inserted into it grips the lateral wall in a clamping manner. You are referred to FIG. 12. There it can be seen moreover that, to form a grasping structure aligned on the basis of a cylindrical lateral surface, compensating ribs 34 are also formed onto the lateral wall of the frustoconical body 33. Three ribs disposed such that they are distributed at equal angles are sufficient for example; four are represented.

At the foot of the frustoconical body 33, allowance is made for apertures 35 interrupted by radial cross-pieces. The liquid 3 passes via these apertures into the central channel 22.

As far as accommodating the liquid 3 to be delivered is concerned, a throughflow opening 36 is allowed for this purpose in the wall part on the flange side of the tubular intermediate portion 20. This connects to the interior of a connecting piece 37. This in turn is connected to a rising tube 38, the free end of which reaches down to the base of the bottle 1, where it has a structure which cannot be kept closed.

The pump 4 which can be actuated by a hand lever has a double-sleeve piston as pump piston 13. Its two axially spaced-apart sleeves 39, tapering into annular lips, leave between them an annular space 40. In the basic position of the pump 4, said annular space connects to a venting opening 41 of the housing 8 of the pump 4. It (40) keeps the venting opening 41 closed. On the other hand, the venting opening 41 is run over in a slide-like releasing manner when the pump 4 is actuated. The venting opening 41 then connects on the side facing the bottle to the bottle interior 2. Formed on the pump cylinder 12 on the underside of the pump chamber 17 is a connecting piece 42, which goes over peripherally into a screw cap 43, which can be connected in a sealing manner to the neck 5 of the bottle 1.

The pump piston 13, acting in the described way at the same time in the manner of a valve slide, when actuated finally leaves the region of the vent opening 41 in such a way that said opening then connects to a channel 44, provided by the end 14 of the pump cylinder 12 that is open on the right-hand side. The connection to the atmosphere, that is to say equalization of the air, takes place by this means.

The displacement of the pump piston 13, actuated by the hand lever, in the pump cylinder 12 acting in a guiding manner in this respect takes place linearly. The line identical to the direction of the pump-piston displacement path is indicated in the drawing by x-x. The line x-x extends substantially horizontally in the situation in which the bottle 1 is in the upright position, which also corresponds substantially to the position of use, in which the user grasps the portion of the bottle 1 near the neck, forming a grip.

For the displacement of the pump piston 13, delivering liquid 3, the double-armed hand lever 6 engages with its first arm a, directed inwardly with respect to the housing, or the horns 10, against the pump piston 13 which can be displaced thereby.

The movement-transmitting means is in this case a connecting member of the further actuating mechanism accommodated in the housing 8. The connecting member is disposed in such a way that, by means of the pin-mounted hand lever 6 and with pivoting movement of the same, it pulls the latter along with the pump piston 13 in the direction of the liquid 3 moving toward the mouthpiece nozzle 24. The connecting member is designated furthermore accordingly as the connecting pull member. It bears the symbol G.

The end of the connecting pull member G facing the mouthpiece nozzle 24 engages via a pivot point at the free end of the arm a of the hand lever 6. The jointed connection is formed by a film hinge 45 realized there. In reality, two points that are separate from each other are formed as a film hinge 45, because the connecting pull member G is formed in a frame-shaped manner. This is particularly evident from FIG. 7. It can be seen that the frame is formed by the actual connecting pull member G and the hand lever 6 attached by means of the two points of the film hinge 45, which film hinge points lie at the horns 10 of the hand lever 6 lying above the bearing pin portions 6'. Dominant in the frame formation are side legs 46, which are formed in pairs and run substantially longitudinally parallel. These are profiled to be right-angled in a stabilizing manner. The virtually equal-sided profile, which is slender since it is only subjected to tension, reaches up to just before the film hinge points, where it goes over into connecting lugs 47 corresponding to the width of the horns 10. The tapering goes back on the piston side to the thickness of the vertical angle leg of the side legs 46.

Facing away from the film hinge, the frame-shaped connecting pull member G is connected by an cross-piece 48. Here, the cross-sectional profile mentioned with respect to the side legs 46 is identically present, the horizontal angle leg running peripherally.

The connecting pull member G extends from the rear side 49 of the pump piston 13 formed on at the same time as the cross-piece 48. The connecting pull member G runs on the outside of the pump piston 13 and parallel to the displacement path of the pump piston in the direction of the mouthpiece nozzle 24.

The connection of the pump piston 13 is likewise effected by means of a film hinge 50. The latter is located at the free end of a cross-shaped shank extending from the rear side 49 of the transverse base 16 of the pump piston 13. Here it is possible to use an extremely thin wall because of the stabilizing effect of the polydirectional portions of said shank, merging with narrow edges one into the other. Involved in the first instance in forming the shank is a flat portion 51. This extends horizontally. It runs in the diametrical line of the circular transverse base 16. The horizontally aligned flat portion 51 goes over with its outwardly directed edge into the film hinge 50, subsequently to the respective inner side of the cross-piece 48 aligned transversely to the line x-x. Virtually the entire clear cross-section of the pump cylinder 12 is used for the forming of the hinge.

Figure 10:
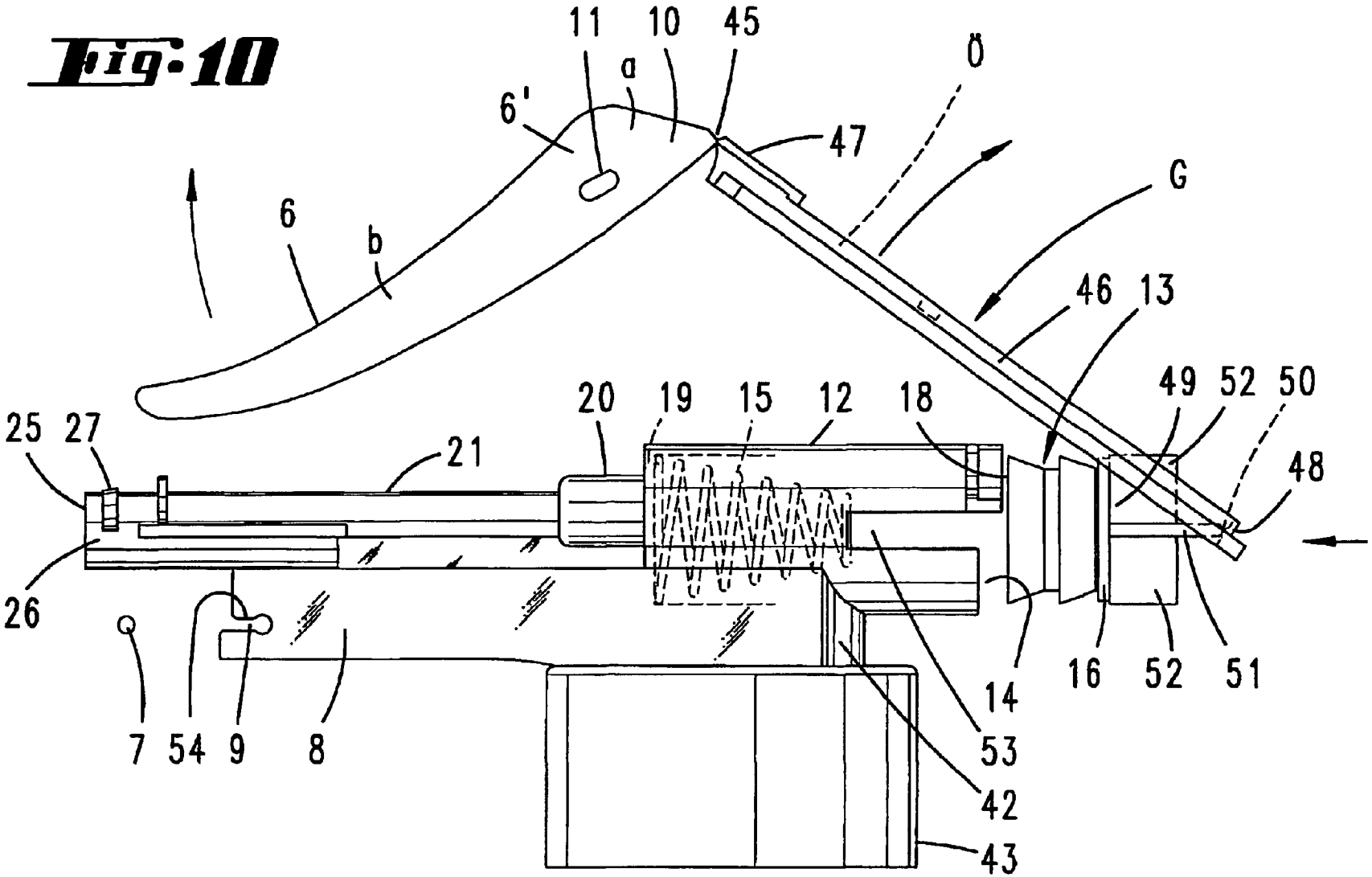
FIG. 10 shows in side view the housing of the spray pump, spring-loaded and with the pump piston disposed in a plug-in manner, using the connecting pull member as a mounting handle.
Figure 11:
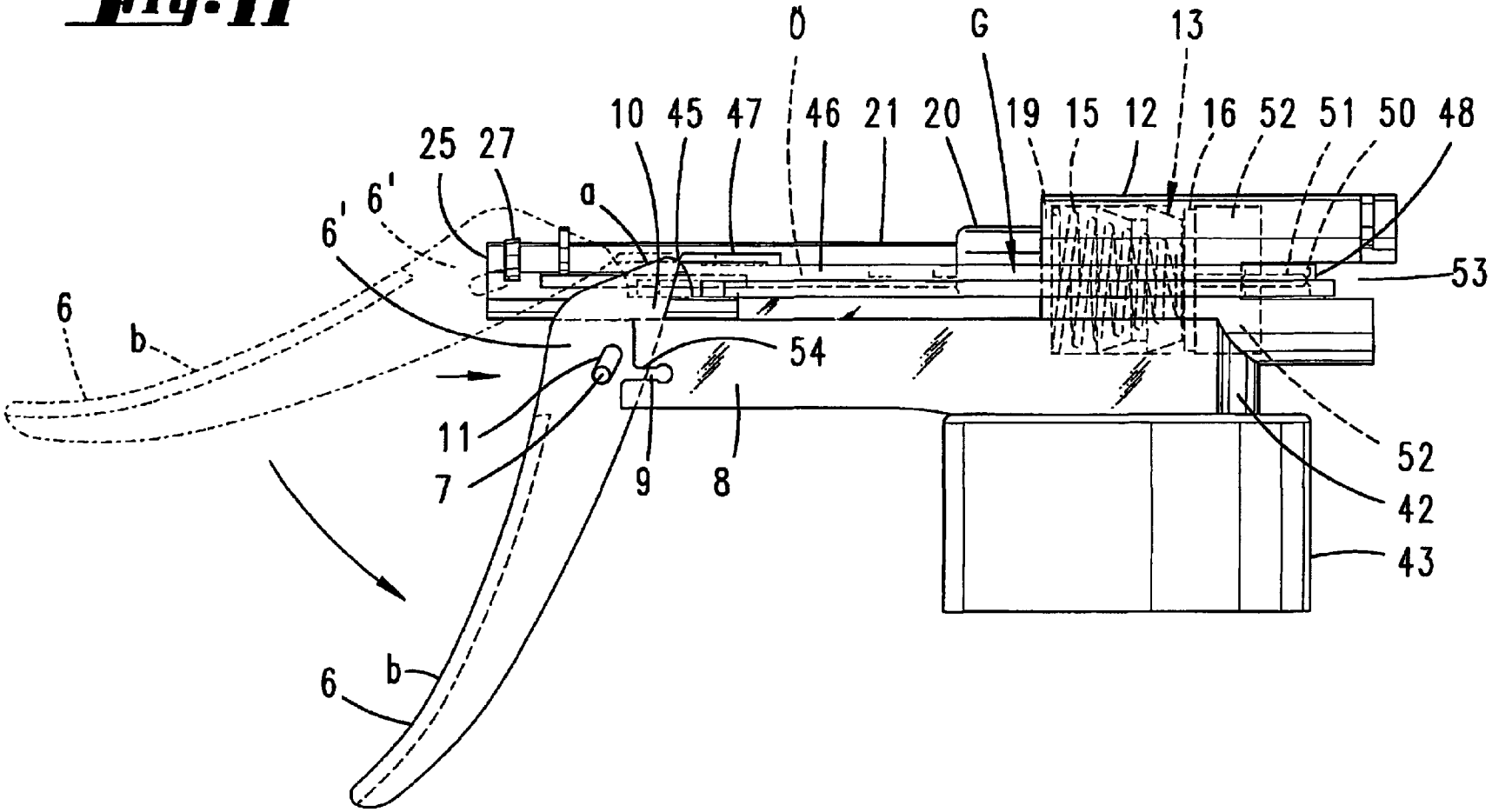
FIG. 11 shows a representation like FIG. 10, but with the associated pump piston and before the hand lever mounting is brought about in slits of the housing that are open counter to the compressive force of the compression spring

When the film hinge 50 is formed, it is ensured that there is adequate articulation, which allows the pump piston 13 to be comfortably inserted via the open end 14 of the pump cylinder 12, as evident from FIG. 10, the frame-shaped connecting pull member G allowing itself to be swung out upward at an acute angle to the line x-x.

In this case, any contortion of the cup-shaped pump piston 13 or bending of the plate-shaped flat portion 51 is effectively ruled out, mainly on account of the cross-sectionally cross-shaped shank. This results from the fact that the flat portion 51 has associated upright, upwardly and downwardly aligned stabilizing portions 52. These originate with their narrow edges, facing the transverse base 16, in the latter. The axial length of the stabilizing portions 52 represented, likewise running in the diametrical line, is somewhat shorter than the length of extent of the flat portion 51 going to the right.

Lying in the running region of the horizontal cross-piece 48, the pump cylinder 12 has, extending from the end 14 of the latter that is open on the right-hand side, a longitudinal slit 53. This extends horizontally and appears as pairs of wall incisions, starting from the end 14 that is open on the right-hand side of the pump cylinder 12. The vertically measured slit width is such that the cross-piece 48 runs in such a way that it is guided in the longitudinal slit 53.

The end 14 of the pump cylinder 12 is stepped in such a way that the part of the wall lying above the longitudinal slit 53 projects with respect to the lower portion virtually in the manner of a canopy. This allows advantageous prepositioning for mounting and an alignment aid for the pump piston 13 to be inserted.

While said pump piston 13 is being inserted into the open end 14, the frame-shaped connecting pull member G, circumscribing as it were a slot-like opening Ö, is pulled in the direction of the mouthpiece 23 over the end 25 of the carrying tube 26 to be fitted with the mouthpiece 23, with the hand lever 6 being grasped as a mounting handle, and, after alignment of the connecting pull member G in the line x-x, the hand lever 6 is swung downward, i.e. in the direction of the bottle 1 to be fitted. The fork-shaped region between the horns 10 also serves as a part supplementing the opening Ö in the longitudinal direction.

After passing over the end 25, the bearing pin 7 allows itself to be aligned into a catching position on the housing side, i.e. to be brought into line with the slit 9 disposed in pairs. The compression spring 15, which for example in the case of the basic version is incorporated in advance, acts in the sense of incorporating and even securing the bearing pin 7. It analogously results from all this that the bearing pin portions 6' of the hand lever 6 are hooked into the slits 9 that are open counter to the compressive force of the compression spring 15 and, as already stated, the opening Ö, which is surrounded by the frame-shaped connecting pull member G in the longitudinal direction of the pump (line x-x), is pivoted on the hand lever side of the compressed compression spring 15 over the end 25 of the carrying tube 26 to be fitted with the mouthpiece 23. As can be seen, the flanks of the slits 9 are chosen to be narrower on the entrance side than the bearing opening at the end, so that there are snap edges 54, which can be deliberately overcome by the bearing pin 7.

As far as the escape portion 11 is concerned, which was referred to above and is in the bearing pin portion 6' of the hand lever 6, it makes allowance in terms of length for the pivoting angle and displacement range of the hand lever 6. In this case, both ends of the slot-like slit of the escape portion 11 can be used to form stops, doing so in interaction with the fixed, cross-sectionally circular bearing pin 7, which can also still be pulled into the crossing slits 9, 11 after passing over the free end 25. Such a device avoids lifting of the pivot point formed by the film hinge 45 under the effect of the shorter arm a as the lever arm and consequently upward buckling of the side legs 46 in this region, facing away from the bearing pins, although this buckling movement can be kept small by specific positioning of the bearing spindle of the hand lever 6 or can even be converted into a downward displacement passing via the zenith. For this purpose, the bearing spindle lies vertically under the zenith. Generally even the basic guiding play is sufficient for this. As is evident, the lower flank of the slit 9 projects slightly with respect to the other flank. This provides a welcome insertion orientation aid for the spindle mounting of the hand lever 6. Its bearing pin 7 rests initially on a sill.

After the stirrup-like connecting pull member G has been hooked in, capturing the bearing pin 7, the spray pump is ready to use.

A powerful spray jet can then be delivered, or else a foaming discharge brought about, depending on the function to which the frontal hinged guard 55, having the corresponding device, is set. When it is swung out of the way and captured, the spray jet is produced.

Figure 4:
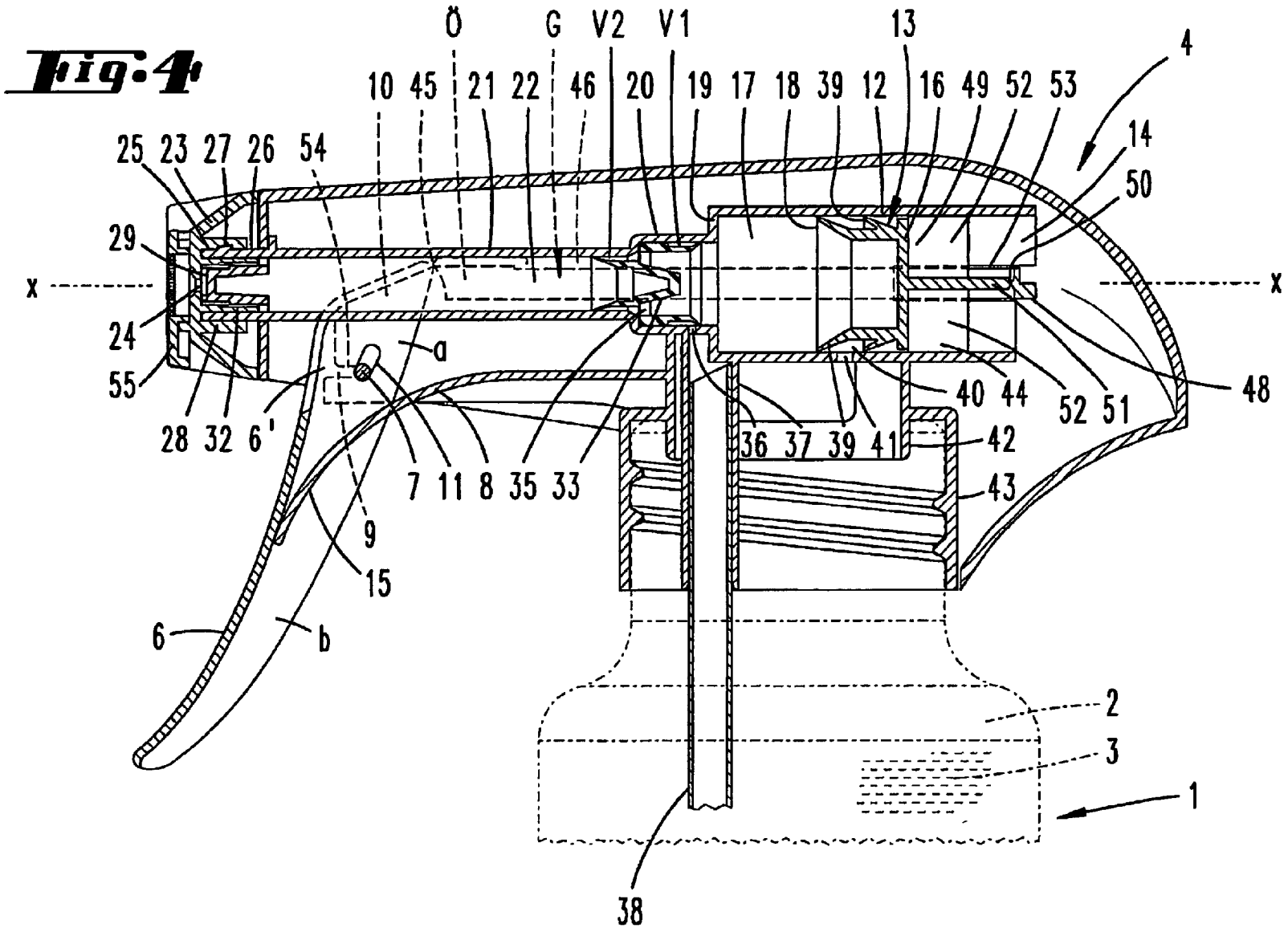
FIG. 4 shows a variant of the spray pump in a representation like FIG. 2, but with an external compression spring formed there, to be precise in the form of a leaf spring acting in a corresponding manner upon the hand lever of the spray pump.

As a departure from the basic version, as FIG. 4 reveals, the compression spring 15 may also be formed as an external spring, i.e. lying outside the pump chamber 17. According to FIG. 4, this actually takes the form that the compression spring 15 is formed as a leaf spring acting on the hand lever 6 in the basic position. Said leaf spring extends from the lateral wall region on the mouthpiece side of the connecting piece 42, initially runs substantially horizontally, to run out after half its length into the form of a downward arc. The end of the leaf spring engages in a guided and protected manner in the pocket-forming U cross-section of the hand lever 6, to be precise against the trigger-forming arm b, more precisely on the inner side of the U cross-piece.

Figure 5:
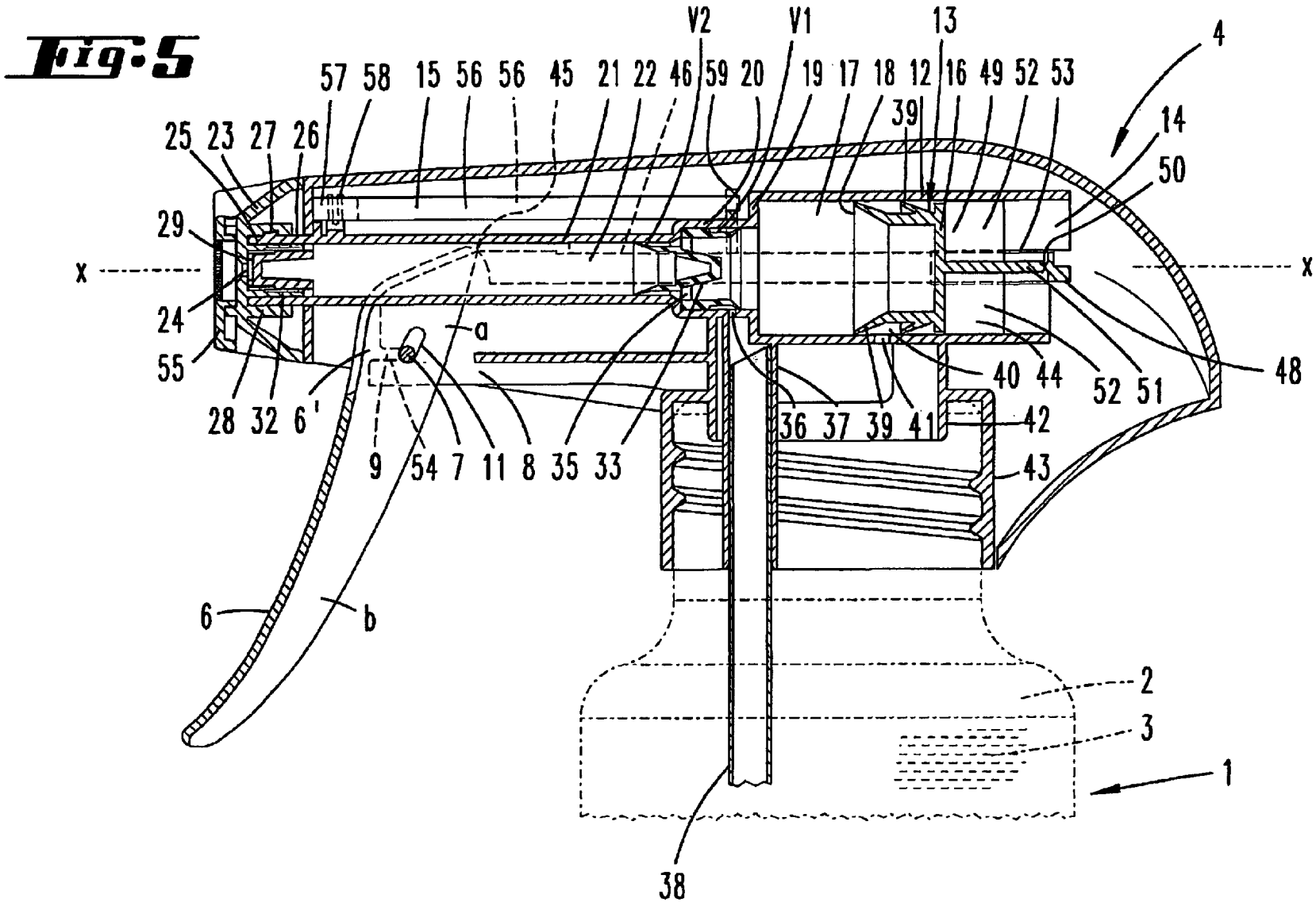
FIG. 5 shows in the same manner of representation a solution modified with respect to the compression spring, which here comprises that the compression spring is formed as a U-clip spring.
Figure 6:
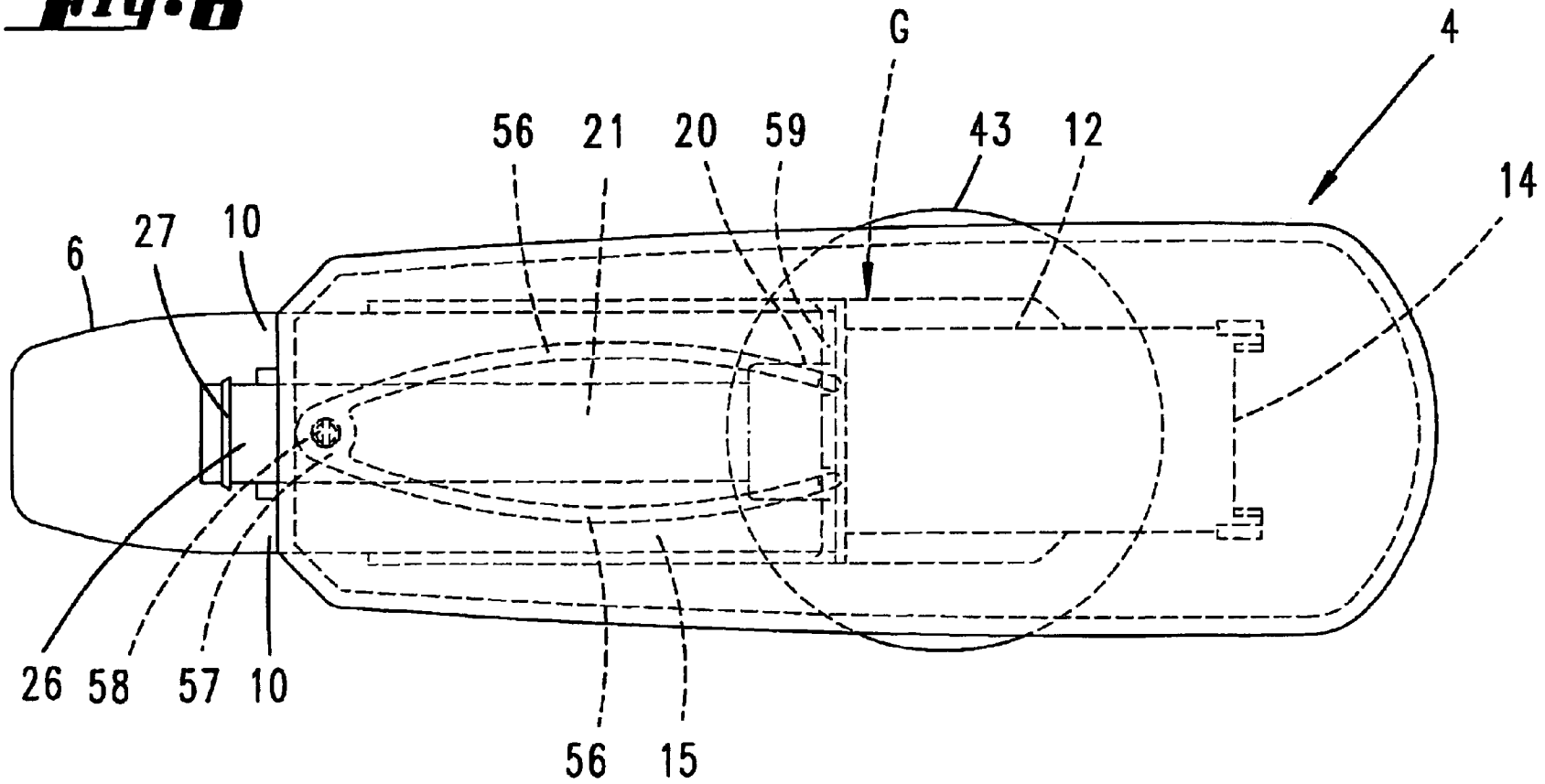
FIG. 6 shows the plan view of FIG. 5, showing the flat-ovalizing shaped U-clip form.

FIG. 5 illustrates a variant such that the compression spring 15 is a clip spring. FIG. 6 shows the double-legged form of the relevant leaf-spring-like compression spring 15. The legs are made to extend slightly arcuately out of the dead center line between the fixing point and the point of actuating engagement. The elastically yielding, resilient legs bear the reference numeral 56. The fixing point on the mouthpiece side is on the spring side a vertically aligned eye 57. This is fitted on a connecting pin 58. The latter has an axial slit formation and keeps the compression spring 15 in position by a mushroom head at the end. The free ends of the legs 56 engage in receptacles of a transverse yoke 59 of the frame-shaped connecting pull member G.

The external compression springs 15 are also preloaded.

Figure 14:
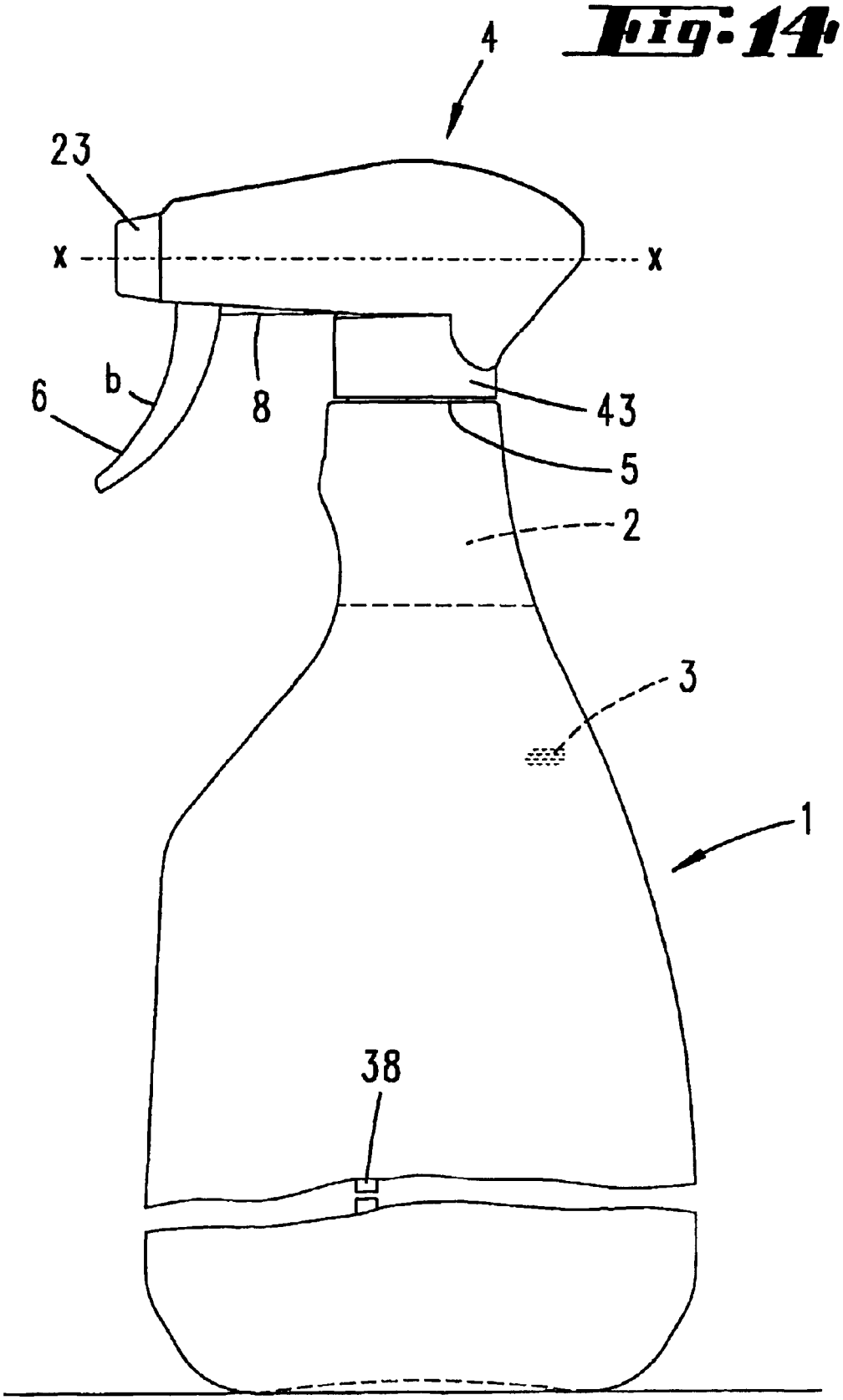
FIG. 14 shows a bottle in side view with a placed-on spray pump, to be precise in the basic position, according to a second exemplary embodiment.

The spray pump with the bottle 1 according to the second exemplary embodiment (FIG. 14 et seq.) is of the same construction as the basic version, described at the beginning, embodying the first exemplary embodiment. Where required for understanding, the reference numerals are used analogously, sometimes without repetition of the text.

While in both exemplary embodiments the bearing pin portions 6' of the hand lever 6 are in principle hooked into open slits 9, loaded by the compressive force of the compression spring 15 toward the inner slit end, the slits 9 are nevertheless open in opposite directions, this on account of the fact that a reversal of the means is used on the second exemplary embodiment, i.e. the bearing pins 7 formed in pairs are located on the housing 8; the slits, designated here too by 9, are formed on the hand lever 6, to be precise lying in the region of the bearing pin portions 6'.

The bearing pins 7, formed on at the same time, are half-moon-like here. Their circular rear is geometrically enclosed by a slit end in such a way that the slit entrances have a smaller clear width than the diameter of the half-moon-shaped bearing pins 7. The opening lying in the direction of the effective compressive force of the compression spring 15 is evident for example from FIGS. 20 and 21.

That the slits 9 are open in the direction counter to the compressive force of the compression spring 15 and are formed on the housing 8 of the pump 4 can be gathered for example from FIG. 10.

A further design feature of the spray pump according to the second exemplary embodiment is then a further variant of the external mounting of the compression spring 15.

In this way it is incorporated such that it is not in contact with the liquid. As is evident, it is realized as a compression spring lying outside the pump chamber 17 with free actuating access. According to the drawing, the end winding, on the right-hand side in the drawing, of the screw-thread-shaped compression spring 15 offers itself as accessible for actuation. This end bears the reference numeral 60. The other end, provided by the respective end winding of the compression spring 15, is designated by 61. It lies closer to the mouthpiece 23.

The compression spring 15 is accommodated in an elongate spring chamber 6, similar to a cartridge bearing. Its geometrical longitudinal axis y-y extends spatially parallel above the explained line x-x. It (62) is formed in part by a fixed portion of the housing 8 and a movable portion of the actuating mechanism. The portion on the housing side is a passage delimited by parallel-running side walls; the movable portion provides a cover 64 engaging over said passage. The portions circumscribe a substantially prismatic cavity cross-section, in which the compression spring 15 is received with adequate side play, but protected against buckling.

Figures 17, 18:
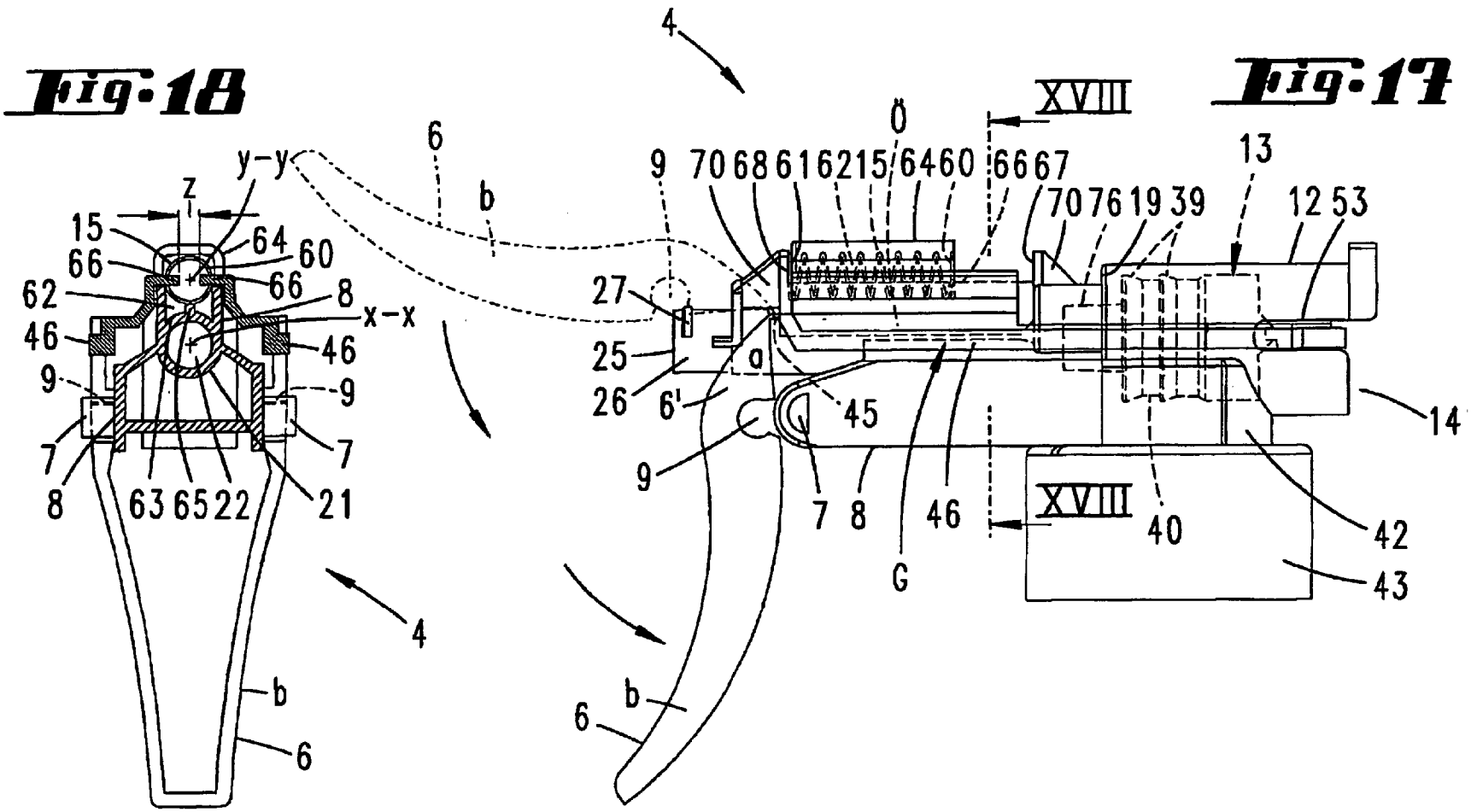
FIG. 17 shows a representation like FIG. 16, but with the associated pump piston and before the hand lever mounting is brought about in slits of the housing that are open in the direction of the compressive force of the compression spring (shown by dash-dotted lines is an intermediate mounting phase, illustrating the pivoting of the connecting pull member along with the hand lever over the free end of the carrying tube to be fitted with the mouthpiece)
FIG. 18 shows the section according to line XVIII—XVIII in FIG. 17, showing the external spring chamber for the compression spring and the actuating finger for the compression spring, realized on the frame-shaped connecting pull member.

The base of the passage 63, as revealed by FIG. 18, has a longitudinally running comb 65, on which the compression spring 15 rests in a slidable manner. In adaptation to the spring cross-section, the comb 65 is formed differently in height or else can be omitted entirely.

The cover 64 is formed onto the frame-shaped connecting pull member G.

As is evident, the compression spring 15 runs only partially inside, or underneath the cover 64. This provides the indicated free actuating access of the compression spring 15. This specifically takes the form that an actuating finger 66, acting via the free access, is formed on the frame-shaped connecting pull member G. Said actuating finger reaches into the cross-sectional region of the compression spring 15. It engages over the end 60 of the same.

The actuating finger 66 provides a construction in pairs. This is evident from FIG. 18. Also evident there is that a horizontal portion is guided in a supported manner on the upper, horizontally running extreme ends of the walls laterally delimiting the passage 63. On the outside of these walls, a vertical portion of the actuating fingers 66 is connected at right angles toward the base and connects to a obliquely outwardly directed, descending connecting portion, which finally runs into the side legs 46 of the frame-shaped connecting pull member G. The horizontal portions of the actuating fingers 66 extend substantially in the diametrical line of the cylindrical compression spring 15 of circular cross-section.

The extreme ends of the horizontal portions of the actuating fingers 66 leave between them a gap z. The purpose of such a gap-like spacing of the fingers is explained in more detail further below.

The prestressed reception of the compression spring 15 in the spring chamber 62 is based on the incorporation between fixed stops of the spring chamber 62 defining the length of the spring chamber 62. The stop facing the end 60 on the actuating side is designated by 67; the stop lying closer to the mouthpiece 23 and forming the abutment for the other end 61 of the compression spring 15 bears the symbol 68. With respect to both stops 67, 68, they are jaws running perpendicularly to the longitudinal axis y-y and protruding in an upwardly directed manner. They originate in the tubular portion 21 of the central channel 22 of the pump 4.

The degree of biasing of the compression spring 15 depends on how short the effective spacing is chosen to be between the stops 67, 68 in comparison with the basic length of the screw-thread compression spring 15 used, in a way corresponding to the feature that the biasing of the compression spring 15 is achieved by a shorter length of the spacing between stops 67, 68 of the spring chamber 62 than the length of the compression spring 15. About 1/10 of the spring length is allotted to the corresponding pre-compression.

Figures 19, 23:
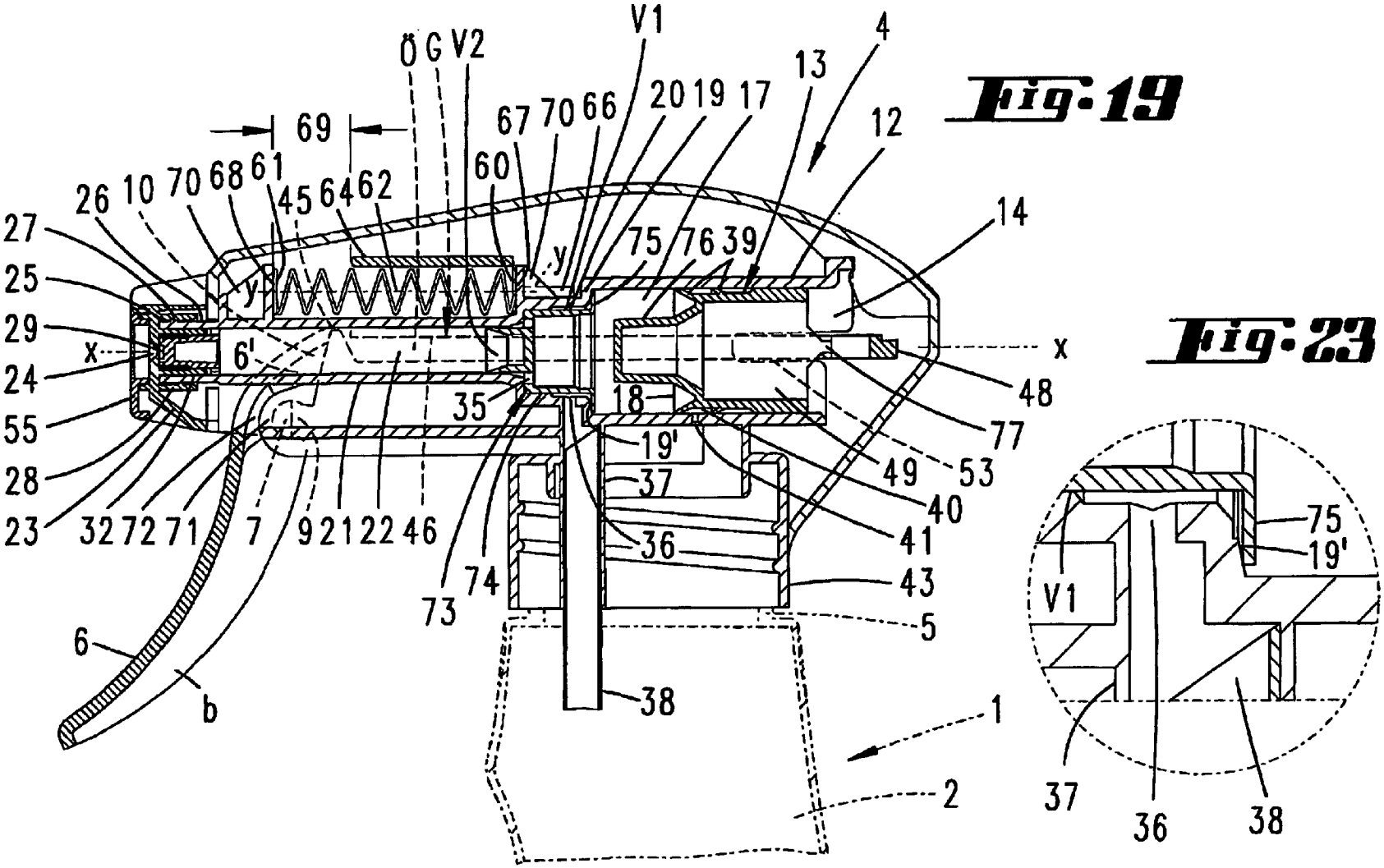
FIG. 19 shows a vertical section through the spray pump with the bottle neck indicated, in the basic position, enlarged in comparison with FIG. 14.
FIG. 23 shows an enlargement of an excerpt of the insert part forming the inlet valve and outlet valve, here in particular the formation of the radial flange, the latter engaging against a valve seating face fixed to the housing.

While the full clear width of the spring chamber may be used with respect to the stop 68 closer to the mouthpiece 23, in respect of the jaws, the horizontal width of the stops 67 lying closer to the pump chamber 17 is clearly narrowed. The corresponding removal of material is such that the stop 67 is somewhat smaller than the width of the horizontal gap z between the actuating fingers 66. The actuating fingers 66 can consequently run over said stop 67 on the pump chamber side. In other words, irrespective of the actuating fingers 66, the end 60 of the spring close to the pump chamber is supported on the stop 67 in the basic position of this pump which can be actuated by a hand lever. Your are referred to FIG. 19. There, the actuating fingers 66 enter the region of the lateral surface of the tubular intermediate portion 20 of greater cross-section in comparison with the tubular portion 21 and end before the wall step formation 19 of the housing 8, if appropriate using stops. In this position, the extreme end on the pump chamber side of the rising-up part of the cover 64 is at the level of the respective stop 68, which may also be configured in a stop-forming manner with regard to the extreme end. The extreme end of the cover 64 facing the mouthpiece 23 is away from the respective stop 68 by an amount equivalent to the degree of the actuating stroke 69 of the pump mechanism in the basic position of the pump 4. When the hand lever 6 is actuated, this extreme end comes up against the respective stop 68, acting in a stop-limiting manner, as revealed by FIG. 20. The further the actuating fingers 66 compress the compression spring 15, the more the spring body comes increasingly, and finally entirely, under the chamber-providing effect of the cover 64. The compression spring is consequently supported well radially and cannot buckle out of the spring chamber 62.

The further function of the spray pump which can be actuated by hand is not to be explained any further here, since it is evident from the description of the basic version, respectively the first exemplary embodiment.

The stops 67 and 68 are stabilized in their respective rear by a supporting strut 70 allowed for during the injection molding, so that it is possible to use extremely thin walls.

With regard to the hand lever 6 of the pump 4, apart from the further measure that the slits 9 are also formed on the bearing pin portions 6' of the hand lever 6 with an opening lying in the direction of the compressive force of the compression spring 15, the measure is also taken that the slit end shaped as a portion of a circle is widened in its surface area by an angled-away flanged collar 71. The slit end no longer has the wall thickness of the hand lever 6 of U-shaped cross-section, but a proportionate width, which is obtained from the in any case present clear spacing between the U legs of the hand lever 6. The flanged collar 71 may continue in the manner of a keyhole into the region of the narrowed opening, that is the entrance of the slit. The stabilization aimed for in this way is also enhanced by the measure that hand lever material at the slit ends is also used from the region of the U legs of the hand lever 6 of U-shaped cross-section, which material is drawn in the manner of an arc strip 72 against the rear of the flanged collar 61 (you are referred for example to FIG. 19).

Inlet valve V1 and outlet valve V2 are also realized as an integral component in the case of the second exemplary embodiment, and further referred to as insert part 73. This lies in an ante-chamber 74, which is disposed ahead of the pump chamber 17 in the direction of the mouthpiece nozzle 24, and in which, using the entire length of the same, said insert part is protected. Since the compression spring 15 has been relocated out of the pump chamber, the wall step formation 19 between the tubular intermediate portion 20 and the pump cylinder 12 is now free on the inside. Making use of this, the end portion of the inlet valve V1, which otherwise has a customary lip, is now lengthened in such a way that it protrudes into the pump chamber 17. Now a radially further extending lip is formed there onto the inlet valve V1, in actual fact in the form of an annular flange 75. The wall step formation, having a multiple wall thickness in the radial direction, now provides by its stepped face 19' the corresponding valve-seat face of the inlet valve V1.

The flange can still be reduced in its wall thickness in comparison with the general wall thickness of the insert part 73. This is also put into practice according to the representation in the drawing. The flange 75 itself has in this case the smallest thickness, which in the cylindrical part of the initial region of the cup portion of the insert part 73 is approximately double and in the remaining wall region is three to five times as much. As a result, an advantageous compromise is achieved between a high inherent stability, which also makes mounting secure, and the aimed-for easy flap action of the flange 75, which engages with biasing against the stepped face 19' of the wall step formation 19, forming the valve-seat face.

Figure 20:
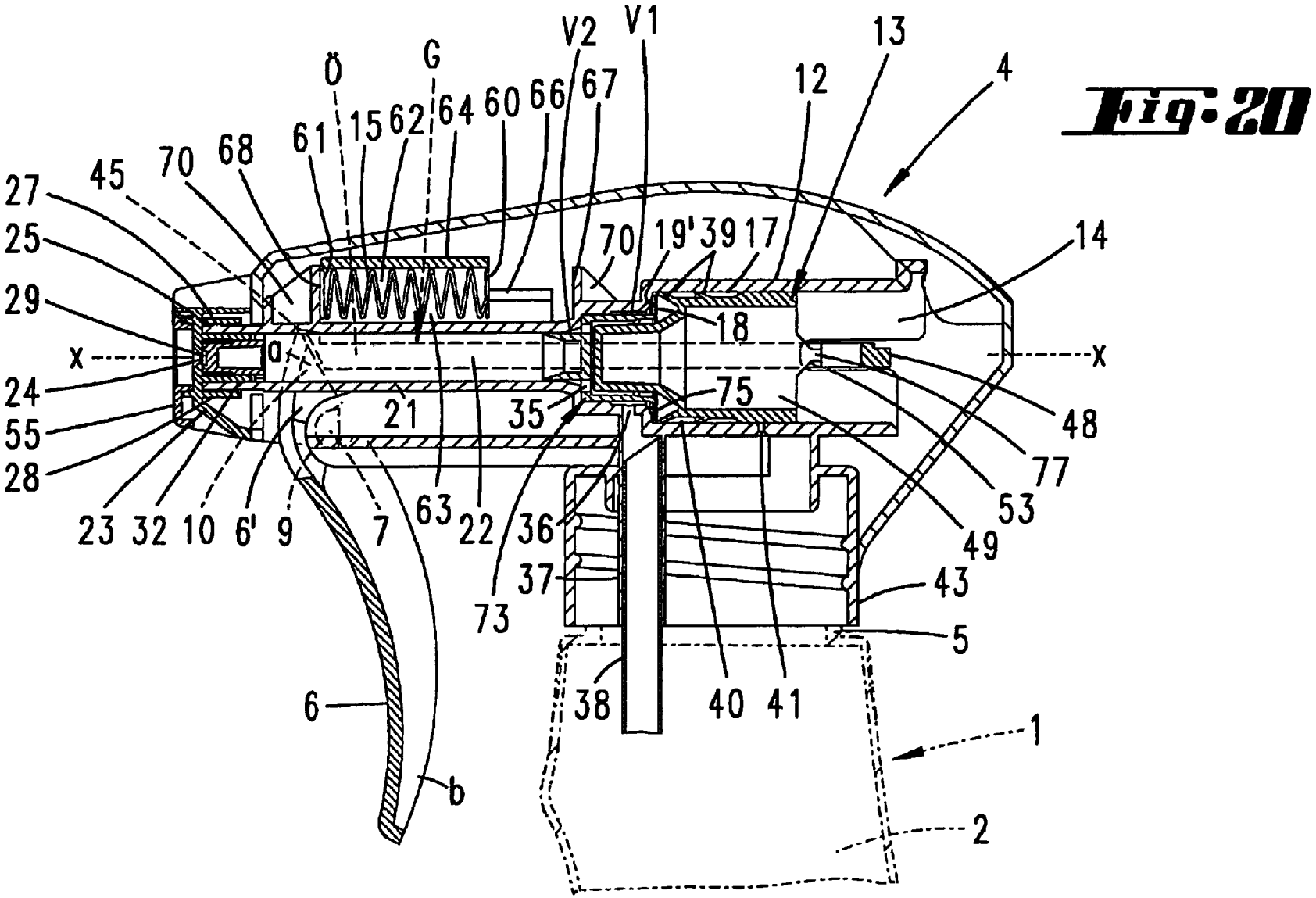
FIG. 20 shows the spray pump in a representation like FIG. 19, but in the state of the actuation of its hand lever.
Figure 21:
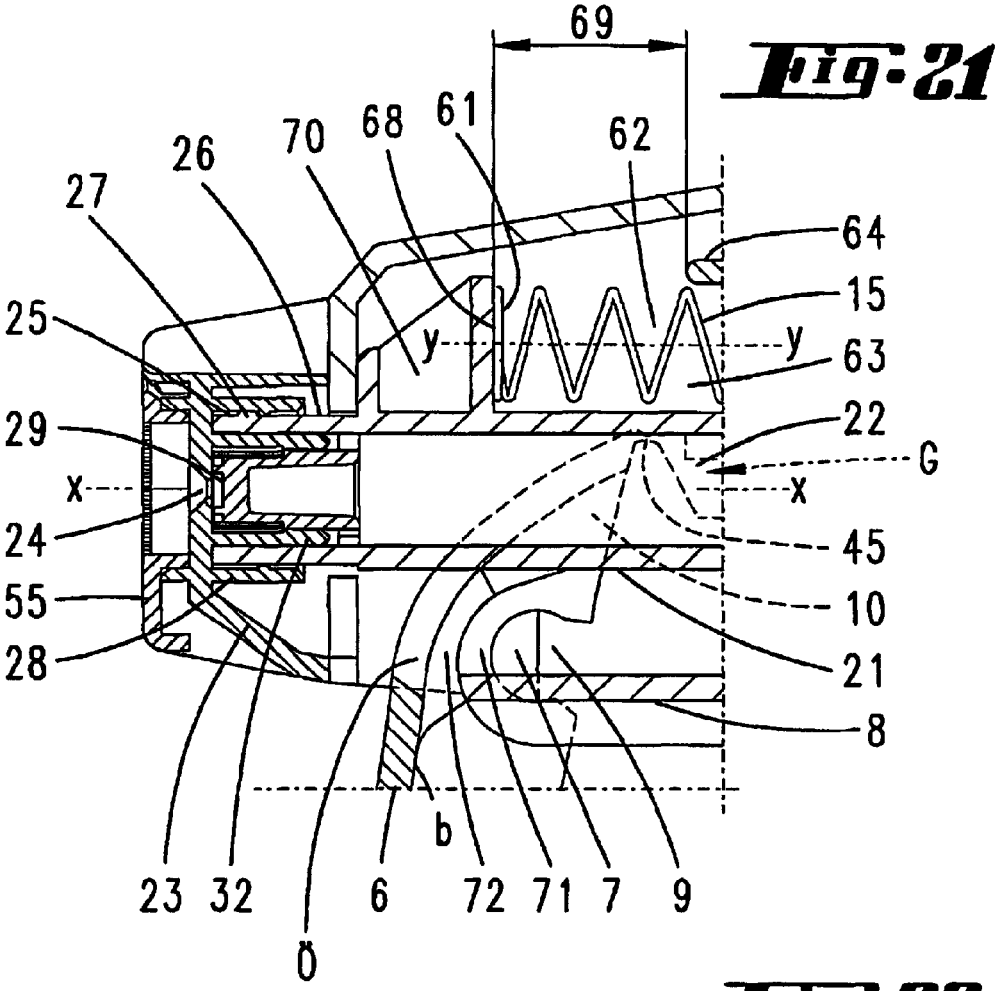
FIG. 21 shows the hand lever mounting as an enlargement of an excerpt from FIG. 19.
Figure 22:
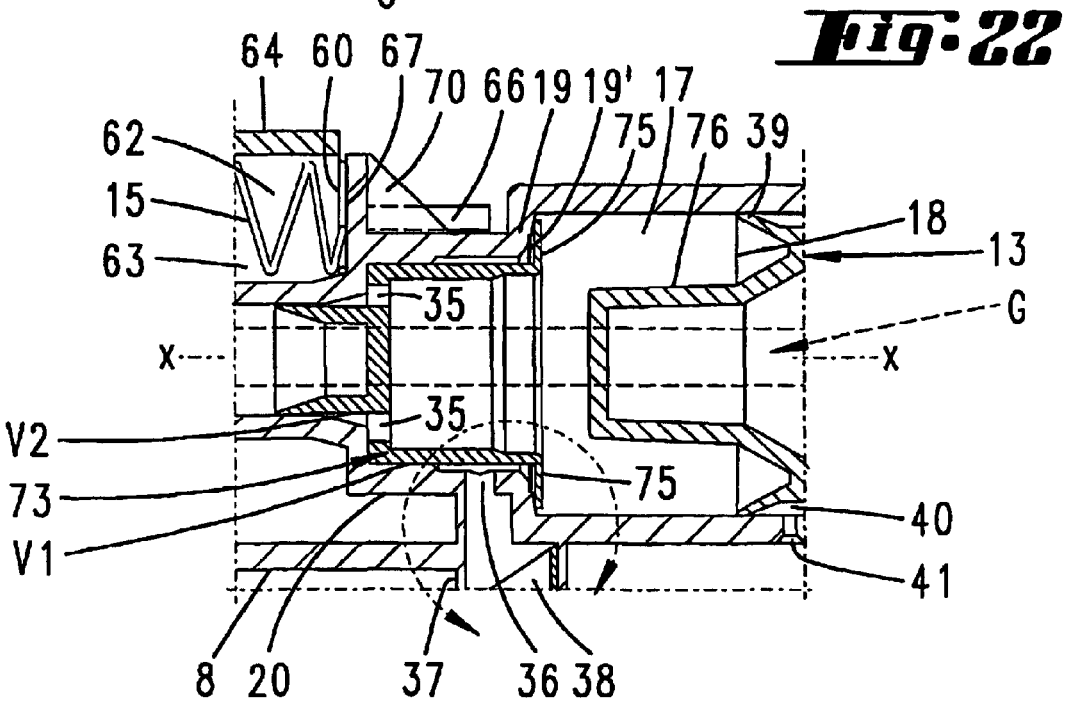
FIG. 22 shows the region of the pump chamber as an enlargement of an excerpt from FIG. 19.

In the case of the insert part 73 according to the development, the central frustoconical body 33, having a flow-dividing effect, is omitted. The cylindrical cup form is instead kept free. In order to clear the pump chamber 17, also extending to the interior of the ante-chamber 74, as completely as possible with respect to the liquid 3 received, the further measure is taken that a displacer projection 76 that fills the throughflow region of the insert part 73 in the actuating end position is formed onto the pump piston 13 (FIG. 20). Said projection originates in the transitional point between the sleeve 39 at the end of the pump piston 13 into the cup body of the pump piston and is realized as a projection everted in the opposite direction. In practice, the transverse base 16 according to the basic version is disposed ahead, into the transitional region with respect to the sleeve 39. The amount by which it is ahead is dimensioned such that, when the sleeve 39 impinges in the periphery of the flange 75, the interior of the insert part 73 is occupied. The liquid 3, flowing through the apertures 35, is forced into the central channel 22 as it runs behind the outlet valve V2.

The valve function of the development is not to be repeated in detail here, since it corresponds to the basic version.

Figure 15:
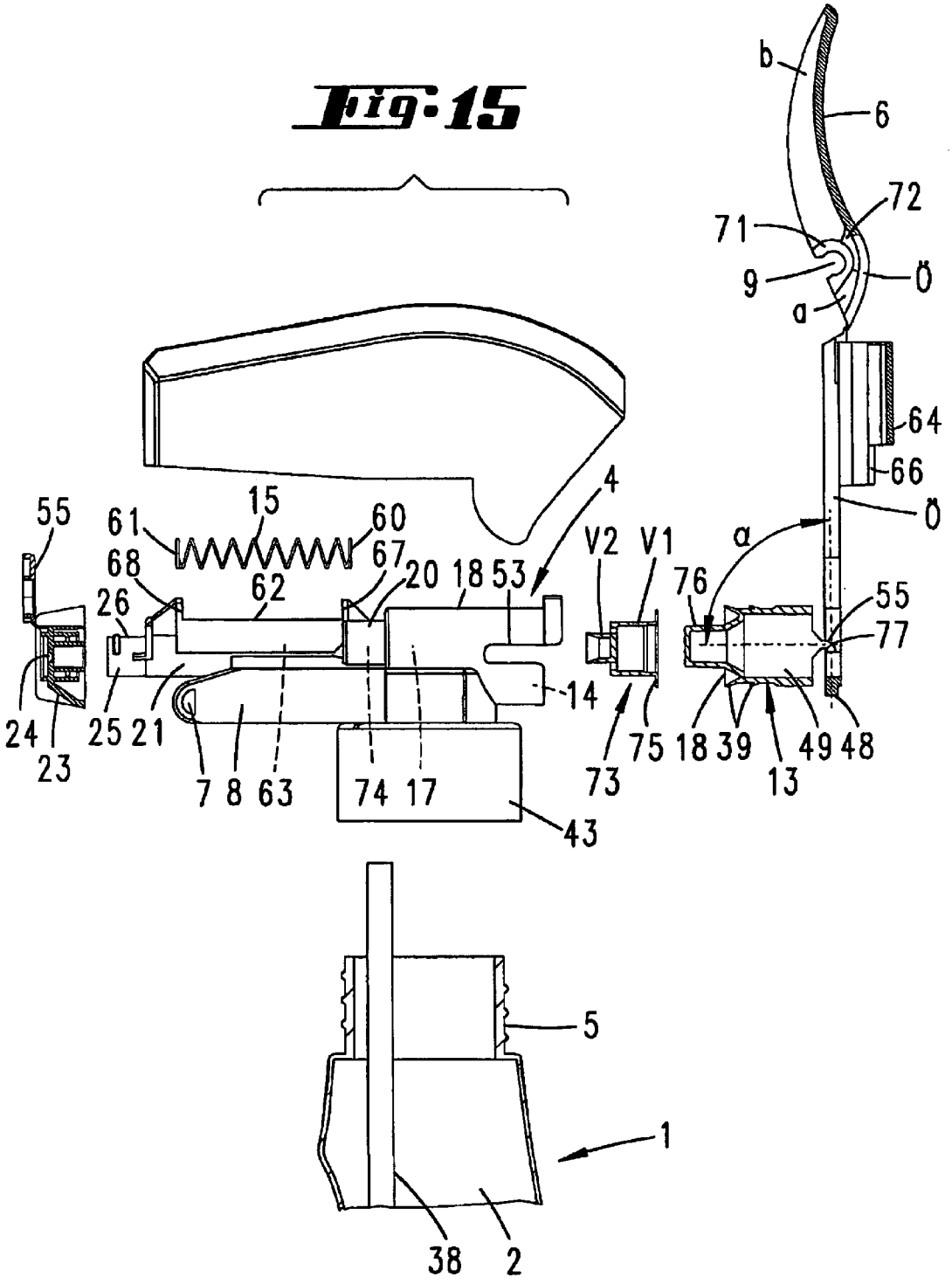
FIG. 15 shows this spray pump in an exploded representation, with respect to some parts in vertical section, with regard to the bottle only showing the region of the bottle neck.
Figure 16:
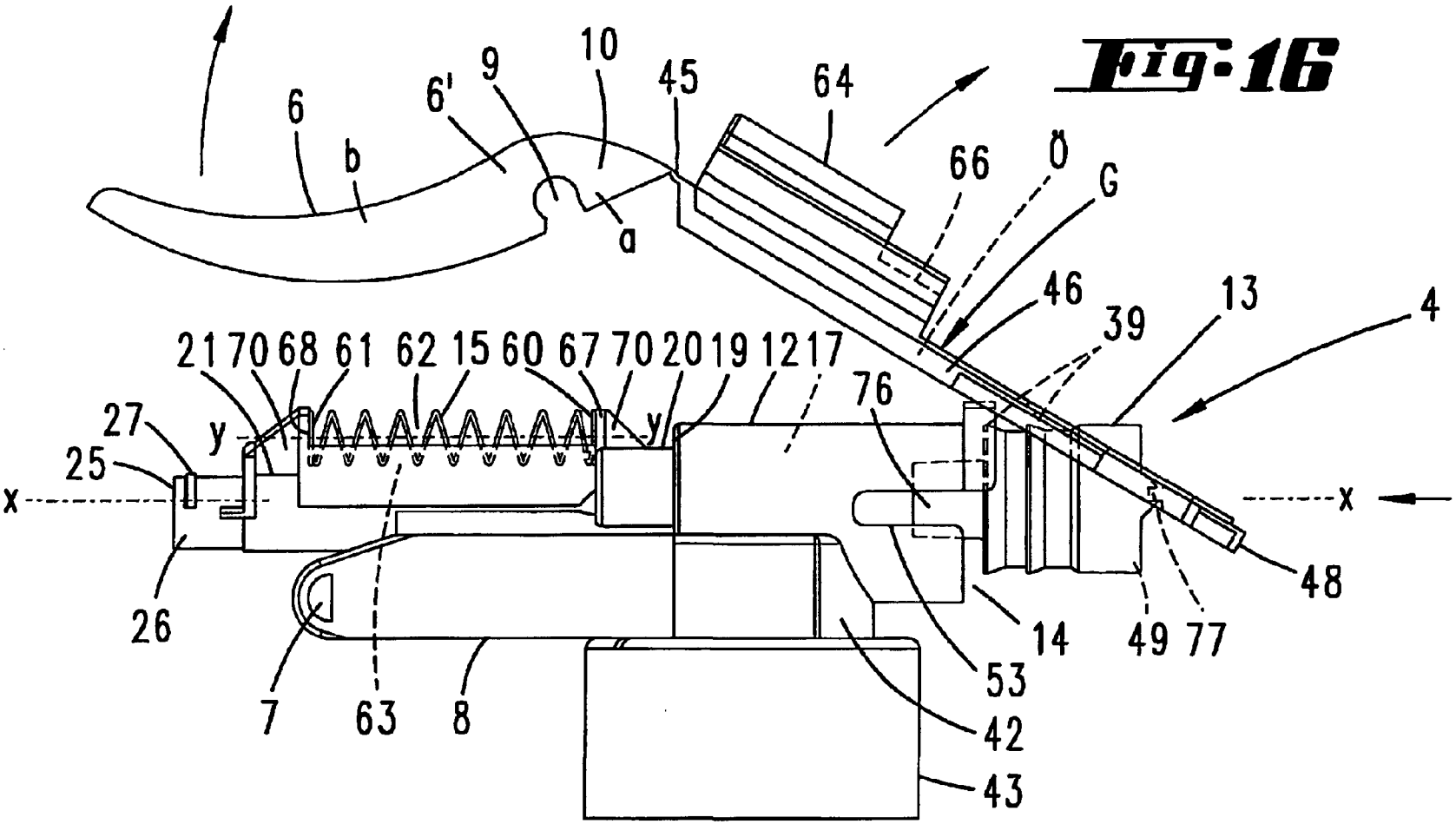
FIG. 16 shows in a side view the housing of the spray pump, spring-loaded and with the pump piston beginning to be disposed in a plug-in, approximately self-locating manner, using the connecting pull member along with the hand lever as a mounting handle.

Since the way described in which the transverse base of the pump piston 13 is disposed ahead means that it is kept open toward its rear side 49 also provides a possibility that is advantageous in terms of production and is used to the extent that the pump piston 13 is connected to the frame-shaped connecting pull member G in a way in which it is more freely accessible via flexible connecting portions 77, which permits in any event pivoting between the pump piston 13 and the connecting pull member G of 90° between the injection-molding position (cf. connecting pull member G in FIG. 15) and mounting position (cf. FIG. 17). The corresponding angle alpha is entered in FIG. 15. It can be seen that the cup cavity of the pump piston 13 is freely accessible for molding and demolding via the portion on the connecting pull member side of the opening Ö of the pull member G. The cross-piece 48 is formed as a curved leg. A film hinge is formed, comparable to that designated by 50 of the basic version. The connecting portions 77 now no longer extend transversely right over the length of the cross-piece 48; instead, the connecting portions 77 lie in a common transverse plane in the diagonal line of the pump piston.

All disclosed features are (in themselves) pertinent to the invention. The disclosure content of the associated/attached priority documents (copy of the prior patent application) is hereby also incorporated in full in the disclosure of the patent application, including for the purpose of incorporating features of these documents in claims of the present application.

What is claimed is:

1. Pump (4) which is actuable by a hand lever for spraying liquid (3), for placing on bottles (1) and containers, with a pump piston (13) which is linearly displacable in a pump chamber (17) on a housing side, against force of a compression spring, for spraying the liquid (3) out of a mouthpiece nozzle (24), the pump piston (13) being coupled to pin-mounted hand lever (6) by means of a connecting pull member (G) in such a way that the pivoting movement of the hand lever (6) pulls the pump piston (13) in direction of the spraying liquid (3) moving toward the mouthpiece nozzle (24), the connecting pull member (G), extending from a rear side (49) of the pump piston (13), extending furthermore parallel to the displacement path of the pump piston in the direction of the mouthpiece nozzle (24), and a cross-piece (48) being provided on the rear side (49) of the pump piston

(13) as a carrier of the pump piston (13), forming a single element therewith, wherein bearing pin portions (6') of the hand lever (6) are hooked into open slits (9), loaded by compressive force of the compression spring (15) toward a slit end, and wherein an opening (Ö), which is partially surrounded by a frame-shaped said connecting pull member (G) in longitudinal direction of the pump, is pivotable on a hand lever side of a compressed said compression spring (15) over end (25) of a carrying tube (26) to be fitted with mouthpiece (23).

2. Pump which is actuable a hand lever according to claim 1, wherein the slits (9) are open in a direction counter to compressive force of the compression spring (15) and are formed on a housing (8) of the pump (4).

3. Pump which is actuable a hand lever according claim 1, wherein the slits (9) are formed on the bearing pin portions (6') of the hand lever (6) with an opening lying in direction of the compressive force of the compression spring (15).

4. Pump which is actuable by a hand lever according to claim 1, wherein the opening (Ö) is formed in part by a formation of the hand lever (6) continued to follow on from the connecting pull member (G).

5. Pump which is actuable by a hand lever according to claim 1, wherein the mouthpiece (23) is clipped onto the end (25) of the carrying tube (26).

6. Pump which is actuable by a hand lever according to claim 1, wherein a bearing pin (7) of the hand lever (6) crosses an escape portion (11) directed obliquely upward away from the mouthpiece (23).

7. Pump which is actuable by a hand lever according to claim 6, wherein flanks of the bearing slits (9) form snap edges (54) for the bearing pin (7) to pass over.

8. Pump which is actuable by a hand lever according to claim 1, wherein side legs (46) of the frame-shaped connecting pull member (G) are connected by film hinges (45) to upwardly directed horns (10) of the hand lever (6) lying above the bearing pin portions (6').

9. Pump which is actuable by a hand lever according to claim 1, wherein the cross-piece (48) of the frame-shaped connecting pull member (G) is connected by a film hinge (45) to a flat portion (51) reaching to the rear side (49) of the pump piston (13).

10. Pump which is actuable by a hand lever according to claim 9, wherein the flat portion (51) has associated upright stabilizing portions (52).

11. Pump which is actuable by a hand lever according to claim 1, wherein the cross-piece (48) runs in a longitudinal slit (43) of a pump cylinder (12).

12. Pump which is actuable by a hand lever according claim 1, wherein the compression spring (15) is formed as a frustoconical spring located in the pump chamber (17).

13. Pump which is actuable by a hand lever according to claim 1, wherein the compression spring (15) is a leaf spring which acts upon the hand lever (6) and is formed integrally with a housing (8).

14. Pump which is actuable by a hand lever according to claim 1, wherein the compression spring (15) is a clip spring with curved, elastically yielding legs (56) which are fixed at their apex on a mouthpiece side of the hand lever (6).

15. Pump which is actuable by a hand lever according to claim 1, wherein the compression spring (15) lies outside the pump chamber (17) but offers free access at an end.

16. Pump which is actuable by a hand lever according to claim 1, wherein there is a housing, and a spring chamber (62) which is fixed to the housing and receives the compression spring (15) in a preloaded manner.

17. Pump which is actuable by a hand lever according to claim 1, wherein the compression spring (15) runs partially inside a cover (64).

18. Pump which is actuable by a hand lever according to claim 17, wherein the cover (64) is formed on the frame-shaped connecting pull member (G).

19. Pump which is actuable by a hand lever according to claim 1, wherein an actuating finger (66) acting via a free access is formed on the frame-shaped connecting pull member (G) and engages over one end (60) of the compression spring (15).

20. Pump which is actuable by a hand lever according to claim 19, wherein the actuating finger (66) is provided in pairs.

21. Pump which is actuable by a hand lever according to claim 16, wherein both ends (60, 61) of the compression spring (15) each have an associated stop (67 and 68, respectively) of the spring chamber (62) which is fixed to the housing.

22. Pump which is actuable by a hand lever according to claim 21, wherein in that the preloading of the compression spring (15) is achieved by a shorter length of spacing between the stops (67, 68) of the spring chamber (62) than a basic length of a screw-threaded said compression spring (15).

23. Pump which is actuable by a hand lever according to claim 1, wherein there is an insert part (73) which simultaneously forms an inlet valve (V1) and an outlet valve (V2) is disposed in the pump chamber (17), the outlet valve (V2) being formed by a lip extending in direction of the mouthpiece nozzle (24) and the inlet valve (V1) forming a flange (75) extending substantially radially to said direction.

24. Pump which is actuable by a hand lever according to claim 23, wherein the flange (75) engages against a stepped face (19') formed in the pump chamber (17) and extending transversely to the direction of pumping displacement of the pump piston (13).

25. Pump which is actuable by a hand lever according to claim 23, wherein the insert part (73) is received in an ante-chamber (74) disposed ahead of the pump chamber (17) in direction of the mouthpiece nozzle (24).

26. Pump which is actuable by a hand lever according to claim 1, wherein in that a displacer projection (76) that fills a cup-shaped throughflow region of the insert part (73) in an actuating end position is formed on the pump piston (13).

27. Pump which is actuable by a hand lever according to claim 1, wherein the pump piston (13) is connected to the frame-shaped connecting pull member (G) by flexible connecting portions (77) which respectively permit pivoting between the pump piston (13) and the connecting pull member (G) of 90° between an injection-molding position and the mounting position.

28. Pump which is actuable by a hand lever according to claim 27, wherein the connecting portions (77) lie in a common transverse plane in a diametrical line of the pump piston.

29. Pump which is actuable by a hand lever according to claim 1, wherein a slit end of the slits (9) is widened by an angled-away flange collar (71).

30. Pump which is actuable by a hand lever according to claim 29, wherein hand lever material at the ends of the slits is supportingly drawn against a rear of the flange collar (71).

* * * * *